US009102186B2

(12) United States Patent
Raming

(10) Patent No.: US 9,102,186 B2
(45) Date of Patent: Aug. 11, 2015

(54) LINERLESS PACKING AND SHIPPING LABEL SYSTEM WITH FOLDED UNDER PACKING LIST

(71) Applicant: Premier Print & Services Group, Inc., Chicago, IL (US)

(72) Inventor: Bruce Raming, Northbrook, IL (US)

(73) Assignee: Premier Print Sevices Group, Inc., Chicago, IL (US)

( * ) Notice: Subject to any disclaimer, the term of this patent is extended or adjusted under 35 U.S.C. 154(b) by 255 days.

(21) Appl. No.: 13/682,475

(22) Filed: Nov. 20, 2012

(65) Prior Publication Data

US 2014/0138277 A1 May 22, 2014

(51) Int. Cl.

| | |
|---|---|
| ***B42D 15/00*** | (2006.01) |
| ***G09F 3/00*** | (2006.01) |
| *G09F 3/02* | (2006.01) |

(52) U.S. Cl.

CPC ..... *B42D 15/006* (2013.01); *G09F 3/0288* (2013.01); *G09F 3/0289* (2013.01); *G09F 2003/021* (2013.01); *G09F 2003/022* (2013.01); *G09F 2003/0229* (2013.01); *Y10T 428/1476* (2015.01); *Y10T 428/15* (2015.01); *Y10T 428/24298* (2015.01); *Y10T 428/24322* (2015.01); *Y10T 428/24777* (2015.01); *Y10T 428/24793* (2015.01)

(58) Field of Classification Search

CPC ..... B42D 15/006

USPC ..... 283/60.1, 66.1–66.2, 79; 428/40.1, 428/42.2, 43

See application file for complete search history.

(56) References Cited

U.S. PATENT DOCUMENTS

| | | | | |
|---|---|---|---|---|
| 5,547,227 | A | 8/1996 | Laurash et al. | |
| 5,776,571 | A * | 7/1998 | Michlin et al. | 428/40.1 |
| 6,616,189 | B2 | 9/2003 | Raming | |
| RE38,976 | E | 2/2006 | Raming | |
| RE39,100 | E | 5/2006 | Raming | |
| 8,109,537 | B2 | 2/2012 | Raming | |
| 8,353,998 | B1 | 1/2013 | Valenti, Jr. et al. | |
| 8,602,214 | B2 | 12/2013 | Raming | |
| 8,777,271 | B2 | 7/2014 | Raming | |
| 8,784,598 | B1 | 7/2014 | Valenti, Jr. et al. | |
| 2002/0113428 | A1 * | 8/2002 | Phillips et al. | 283/62 |
| 2010/0156087 | A1 * | 6/2010 | Raming | 283/79 |

(Continued)

*Primary Examiner* — Kyle Grabowski
(74) *Attorney, Agent, or Firm* — Hovey Williams LLP

(57) ABSTRACT

A shipping label is operable to be applied to a package and includes a single label ply. The single label ply presents longitudinally spaced ends, opposite top and bottom faces extending between the ends, and a generally transverse fold line of weakness spaced between the ends. The label ply is foldable about the fold line to define upper and lower label sections, with the upper label section overlying the lower label section when the label ply is folded, and the top face of the upper label section being operable to receive package address indicia thereon. The upper label section includes a separation line of weakness defining a border portion and a separable central portion. The upper label section includes adhesive applied to the bottom face along at least part of the border portion. The lower label section includes a dividing line of weakness defining a connecting portion and an end portion, with the connecting portion extending between the fold line and dividing line. The end portion is at least in part positioned underneath the central portion of the upper label section when the label ply is folded, with separation of the central portion from the border portion providing access to the end portion thereunder.

61 Claims, 14 Drawing Sheets

(56) References Cited

U.S. PATENT DOCUMENTS

| | | | | |
|---|---|---|---|---|
| 2010/0259037 | A1 | 10/2010 | Hanrahan et al. | |
| 2012/0304600 | A1 | 12/2012 | Bellmyer et al. | |
| 2013/0249205 | A1* | 9/2013 | Bellmyer et al. | 283/81 |
| 2013/0276986 | A1 | 10/2013 | Bellmyer et al. | |
| 2013/0284341 | A1 | 10/2013 | Bellmyer et al. | |

* cited by examiner

LINERLESS PACKING AND SHIPPING LABEL SYSTEM WITH FOLDED UNDER PACKING LIST

BACKGROUND

1. Field

The present invention relates generally to a linerless label system. More specifically, embodiments of the present invention concern a linerless label with label sections that are foldable about a fold line so that one section is folded under the other section.

2. Discussion of Prior Art

Numerous types of business forms are adhesively attached to a substrate, such as a product or a product container. For instance, packing and shipping labels are often adhered directly to a box, envelope, or other packaging for shipping a product. Conventional packing and shipping labels are provided as separate labels for each shipping package, with the packing label normally being held by the shipping label so that the contents indicia printed on the packing label are hidden from view. Another prior art shipping label has been produced in the form of a single-side printed label that folds so that shipping indicia are provided on one side of the folded label and package contents indicia on the other side of the folded label.

Conventional adhesive business forms, including adhesive packing and shipping labels, suffer from various undesirable limitations. For example, adhesive duplex shipping labels are deficient because they involve the use of a label stock, an adhesive pattern on the label stock, and a liner that covers the adhesive pattern when both sides of the duplex label are printed. When the printed label is ready to be applied to a substrate, a portion of the liner is typically removed from the label stock to expose the adhesive and the removed portion of the liner is typically discarded as waste. Similarly, the single-side printed label described above has a liner that is entirely removed to expose adhesive, with the entire liner being discarded. Thus, where the liner is discarded, the use of a large number of labels generates an undesirable amount of liner waste, and results in an inefficient label application process. Also, the liner is problematic to remove from the label stock using conventional automated label printing and application equipment. Yet further, the overall thickness of conventional label substrates can present printing complications and can limit the number of labels on a particular label roll.

SUMMARY

The following brief summary is provided to indicate the nature of the subject matter disclosed herein. While certain aspects of the present invention are described below, the summary is not intended to limit the scope of the present invention.

Embodiments of the present invention provide a linerless label system that does not suffer from the problems and limitations of the prior art labels set forth above.

A first aspect of the present invention concerns a shipping label operable to be applied to a package. The shipping label broadly includes a single label ply. The single label ply presents longitudinally spaced ends, opposite top and bottom faces extending between the ends, and a generally transverse fold line of weakness spaced between the ends. The label ply is foldable about the fold line to define upper and lower label sections, with the upper label section overlying the lower label section when the label ply is folded, and the top face of the upper label section being operable to receive package address indicia thereon. The upper label section includes a separation line of weakness defining a border portion and a separable central portion. The upper label section includes adhesive applied to the bottom face along at least part of the border portion. The lower label section includes a dividing line of weakness defining a connecting portion and an end portion, with the connecting portion extending between the fold line and dividing line. The end portion is at least in part positioned underneath the central portion of the upper label section when the label ply is folded, with separation of the central portion from the border portion providing access to the end portion thereunder. The connecting portion includes an opening that projects from the fold line. The adhesive on the bottom face of the upper label section extends from the fold line to be in registration with the opening when the label ply is folded, such that the upper label section is configured to adhesively attach to the package along the fold line.

A second aspect of the present invention concerns a linerless label roll operable to provide linerless labels for packages. The linerless label roll broadly includes a continuous web of a foldable single ply substrate wound in a roll. The single ply substrate presents a plurality of end-to-end labels. Each of the labels presents longitudinally spaced ends, opposite top and bottom faces extending between the ends, and a generally transverse fold line of weakness spaced between the ends. The label is foldable about the fold line to define upper and lower label sections, with the upper label section overlying the lower label section when the label is folded, and the top face of the upper label section being operable to receive package address indicia thereon. The upper label section includes a separation line of weakness defining a border portion and a separable central portion. The lower label section includes a dividing line of weakness defining a connecting portion and an end portion, with the connecting portion extending between the fold line and dividing line. The end portion presents a narrower transverse dimension than the upper label section, such that the border portion includes longitudinally extending side margins laterally outboard of the end portion. The end portion is at least in part positioned underneath the central portion of the upper label section when the label is folded, with separation of the central portion from the border portion providing access to the end portion thereunder. The upper label section includes adhesive applied to the bottom face along at least part of each of the side margins of the border portion, such that the upper label section is configured to adhesively attach to the package along the side margins. The adhesive on the bottom face of the upper label section permits removable contact of overlaid bottom and top faces of labels within the roll.

A third aspect of the present invention concerns a labeled package assembly to be shipped to a recipient. The labeled package assembly broadly includes a package and a single ply combination shipping label and packing list label. The package contains at least one item to be received by the recipient. The single ply combination shipping label and packing list label is applied to the package in a folded condition. The label presents longitudinally spaced ends, opposite top and bottom faces extending between the ends, and a generally transverse fold line of weakness spaced between the ends. The label is folded about the fold line to define upper and lower label sections, with the upper label section overlying the lower label section. The top face of the upper label section carries publicly displayed package address indicia associated with the recipient, and said top face of the lower label section carries hidden package contents indicia listing the at least one item. The upper label section includes a separation line of weakness defining a border portion and a separable central portion. The upper label section includes adhesive applied to the bottom face along at least part of the border portion. The lower label section includes a dividing line of weakness defining a connecting portion and an end portion, with the connecting portion extending between the fold line and dividing line. The end portion is at least in part positioned underneath the central portion of the upper label section, with separation of the central portion from the border portion providing access to the end portion thereunder. The package contents indicia are provided on the end portion so as to be concealed by the upper label section. The connecting portion includes an opening that projects from the fold line. The adhesive on the bottom face of the upper label section extends from the fold line to be in registration with the opening, such that the upper label section is configured to adhesively attach to the package along the fold line.

Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein:

FIG. 1 is an upper perspective of a linerless label system constructed in accordance with a first embodiment of the present invention, with the system including a printer, a cutting mechanism, a label applicator, and a continuous web of single-ply label substrate that presents a plurality of labels attached end-to-end, with the continuous web being wound in a label roll, and showing the system printing linerless labels from the label roll, cutting the printed labels to detach an end-most label from the label roll, and applying the detached label to a package, and with the label applicator including a label applicator pad and a label fold mechanism pivotally mounted adjacent to the applicator pad;

FIG. 2 is a top view of a printed one of the linerless labels shown in FIG. 1, showing an upper shipping label section and a lower packing list section in an unfolded condition and the label sections having a release coating thereon, with the shipping label section having an endless border portion and a central portion, with perforation lines extending between the border and central portions and defining a tear strip removably connecting the portions, and the packing list section having an end portion and a connecting portion joined along a perforation line, where the border portion and connecting portion are joined along a folding line of weakness;

Figure 9:
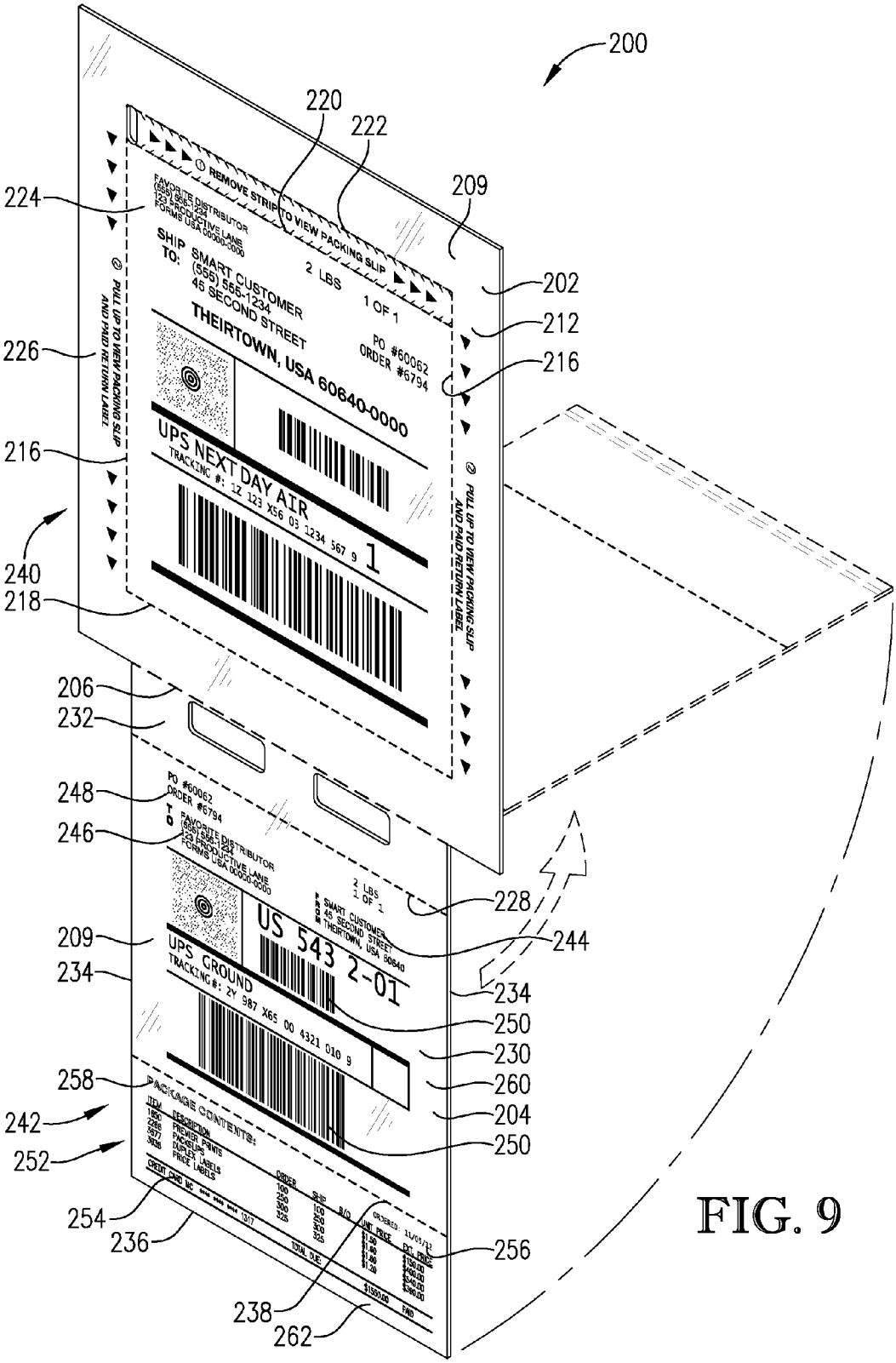
Figure 10:
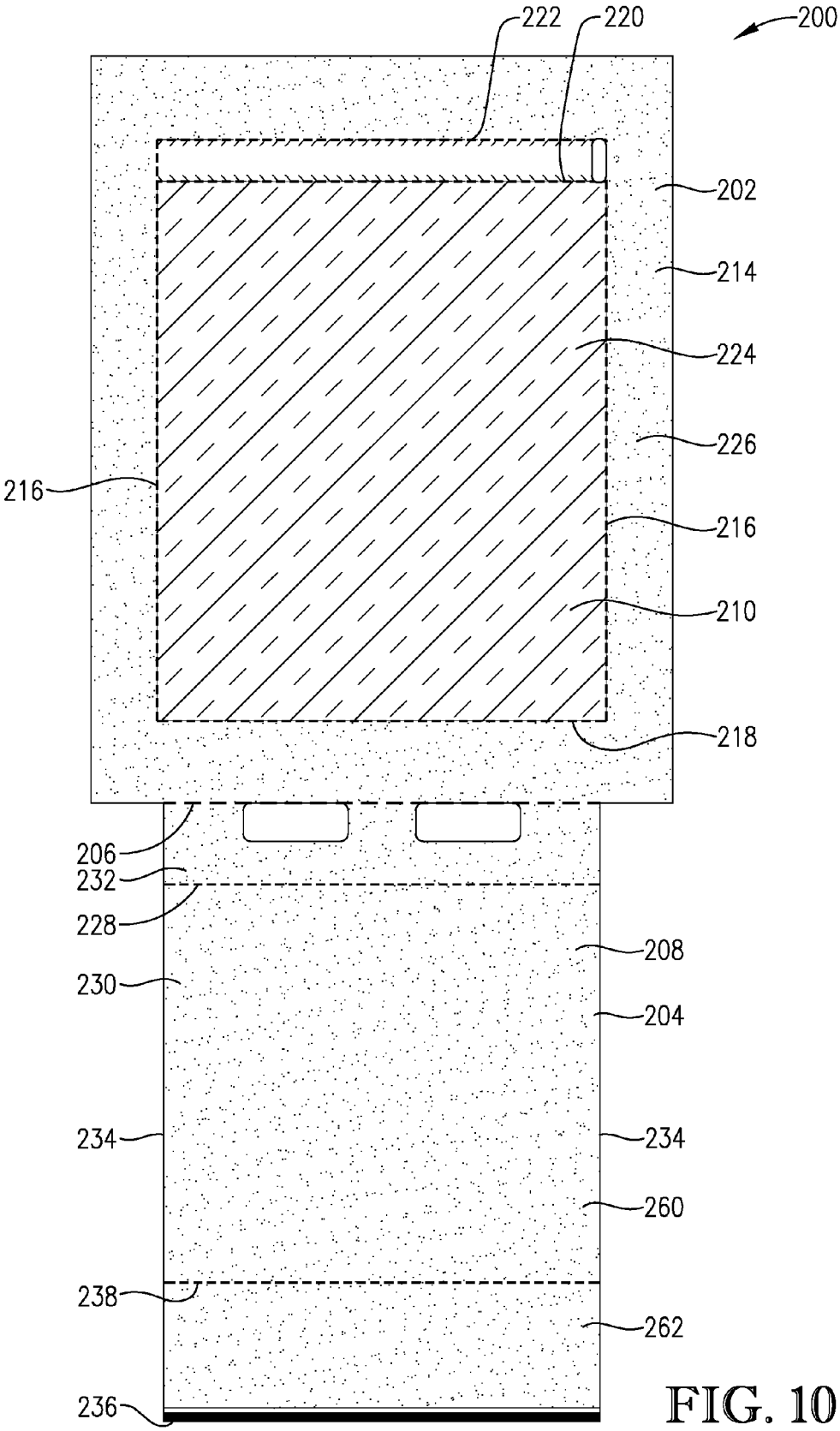
Figure 11:
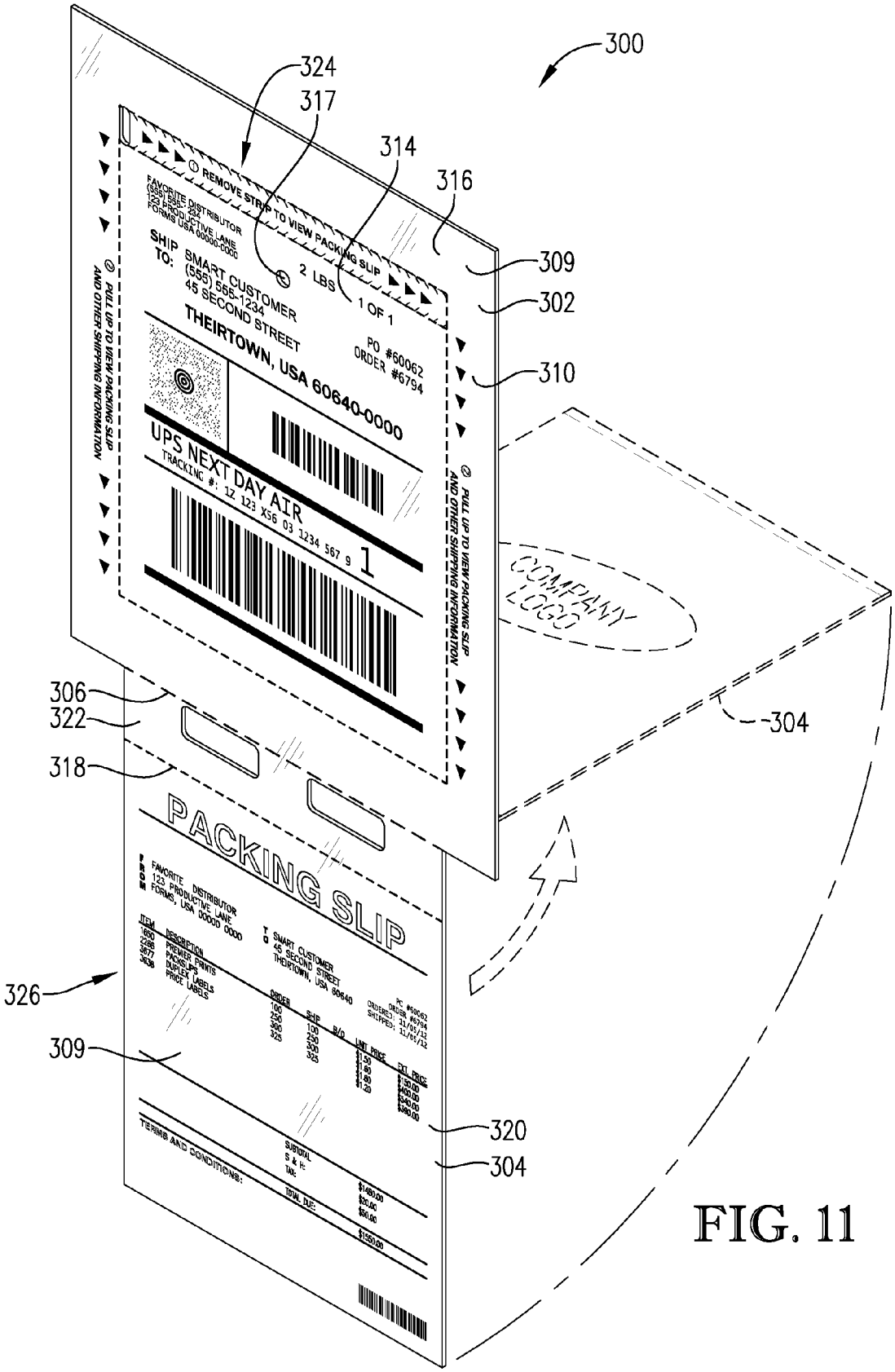
Figure 12:
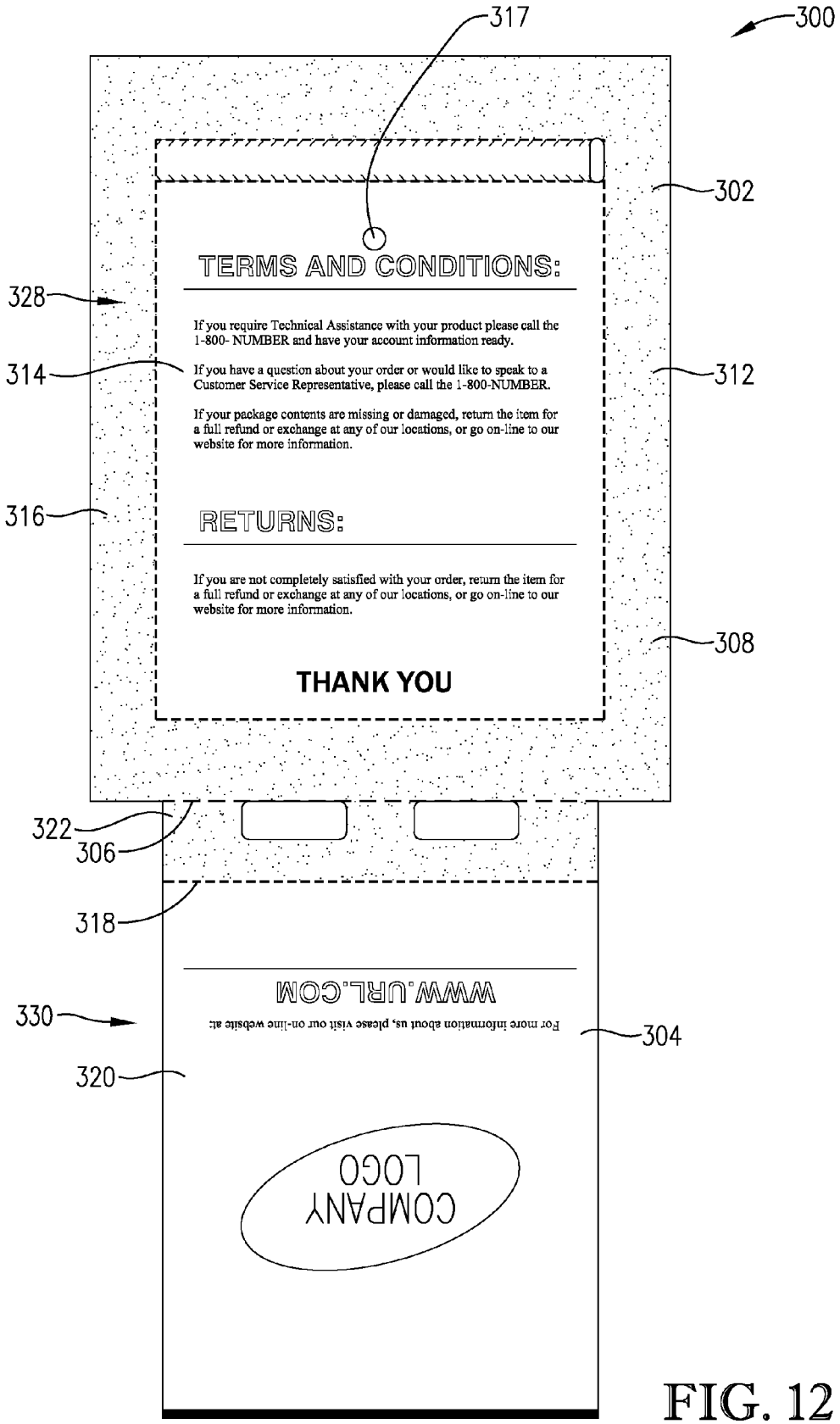
Figure 13:
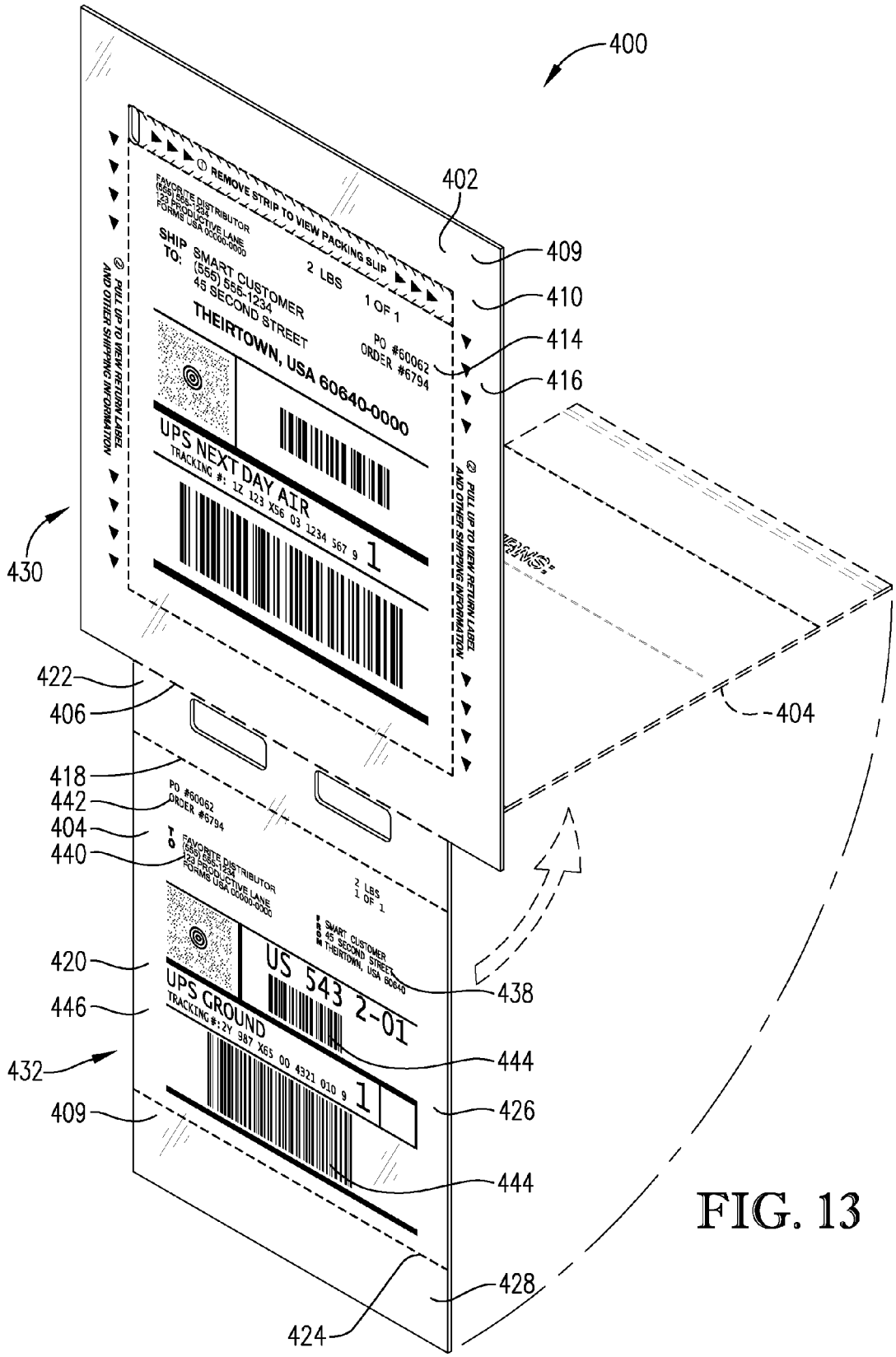
Figure 14:
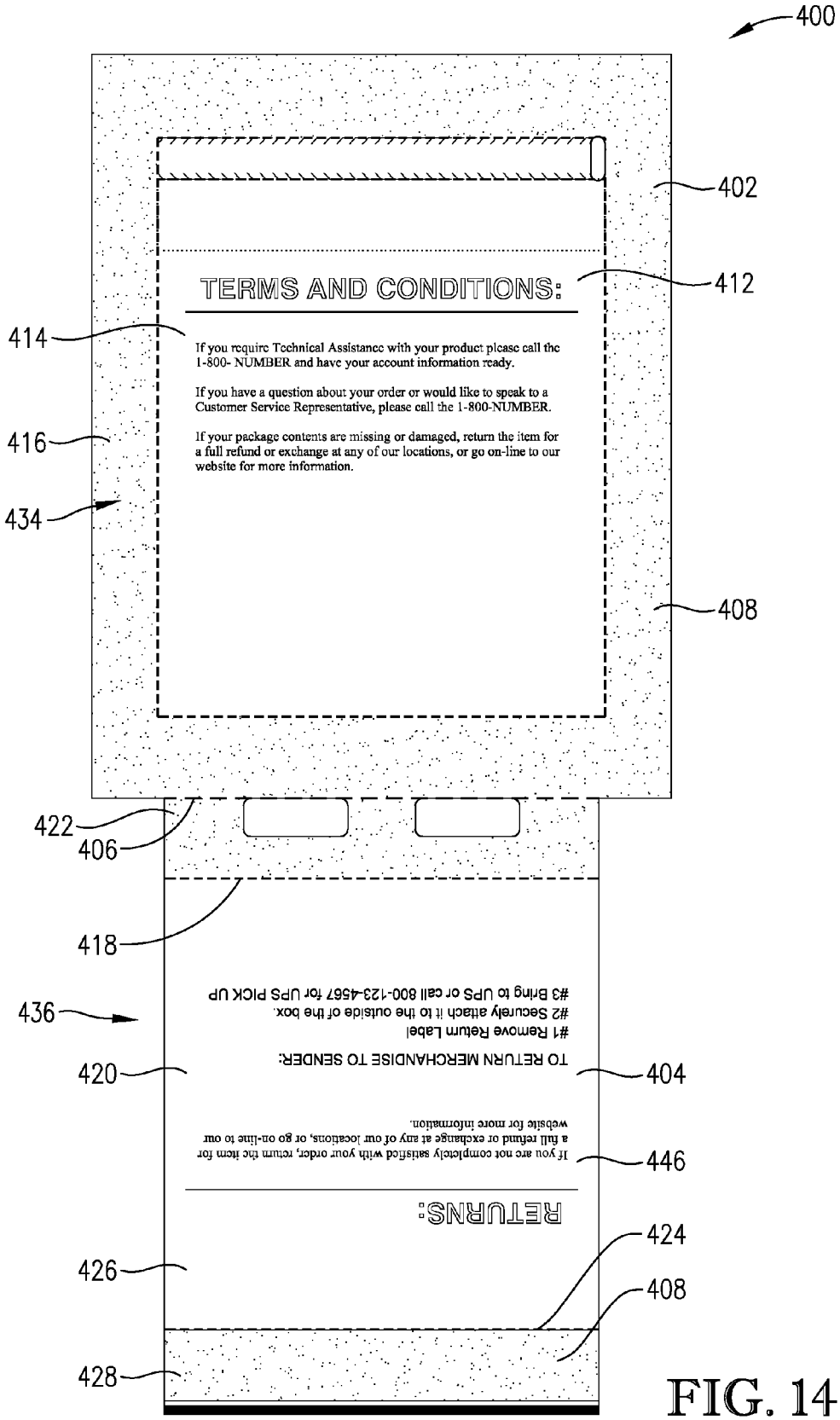
Figure 15:
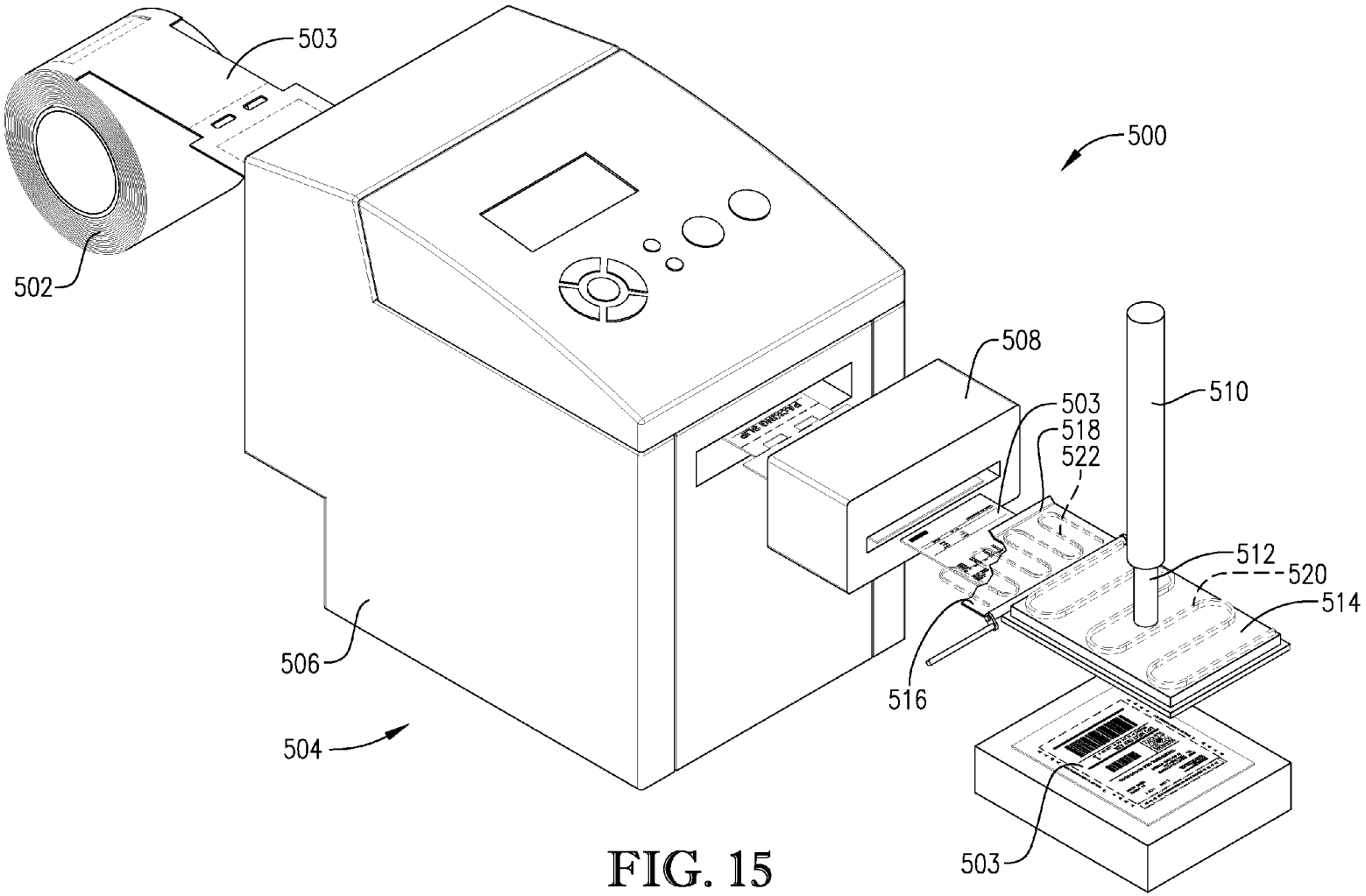

FIG. 9 is a perspective of a linerless label constructed in accordance with a second embodiment of the present invention, showing an upper shipping label section and a lower packing list and return label section in an unfolded condition and the label sections having a release coating thereon, with the shipping label section having an endless border portion and a central portion, and the packing list and return label section having a connecting portion and an end portion joined along a perforation line, where the border portion and connecting portion are configured to be joined along a folding line of weakness;

FIG. 10 is a bottom view of the linerless label shown in FIG. 9, showing an adhesive layer applied along the packing list section and along the border portion of the shipping label section, a release layer applied along the central portion of the shipping label section, and a timing mark that extends along an end of the packing list and return label section;

FIG. 11 is a perspective of a linerless label constructed in accordance with a third embodiment of the present invention, showing an upper shipping label section and a lower packing list section in an unfolded condition and the label sections having a release coating thereon, with the shipping label section having an endless border portion and a central portion, and the packing list section having a connecting portion and an end portion joined along a perforation line, where the border portion and connecting portion are configured to be joined along a folding line of weakness, and where the central portion of the shipping label section presents a circular vent opening;

FIG. 12 is a bottom view of the linerless label shown in FIG. 11, showing an adhesive layer applied along the connecting portion of the packing list section and along the border portion of the shipping label section, and a timing mark that extends along an end of the packing list and return label section;

FIG. 13 is a perspective of a linerless label constructed in accordance with a fourth embodiment of the present invention, showing an upper shipping label section and a lower return label section in an unfolded condition and the label sections having a release coating thereon, with the shipping label section having an endless border portion and a central portion, and the return label section having a connecting portion and an end portion joined along a perforation line, where the border portion and connecting portion are joined along a folding line of weakness;

FIG. 14 is a bottom view of the linerless label shown in FIG. 12, showing an adhesive layer applied along the connecting portion and along an opposite end portion of the packing list section, with the adhesive layer also being applied along the border portion of the shipping label section, and a timing mark that extends along an end of the return label section; and FIG. 15 is an upper perspective of a linerless label system constructed in accordance with a fifth embodiment of the present invention, with the system including a printer, a cutting mechanism, a label applicator, and a continuous web of single-ply label substrate that presents a plurality of labels attached end-to-end, with the label applicator including a heated label applicator pad and a heated label fold mechanism pivotally mounted adjacent to the applicator pad.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 1:
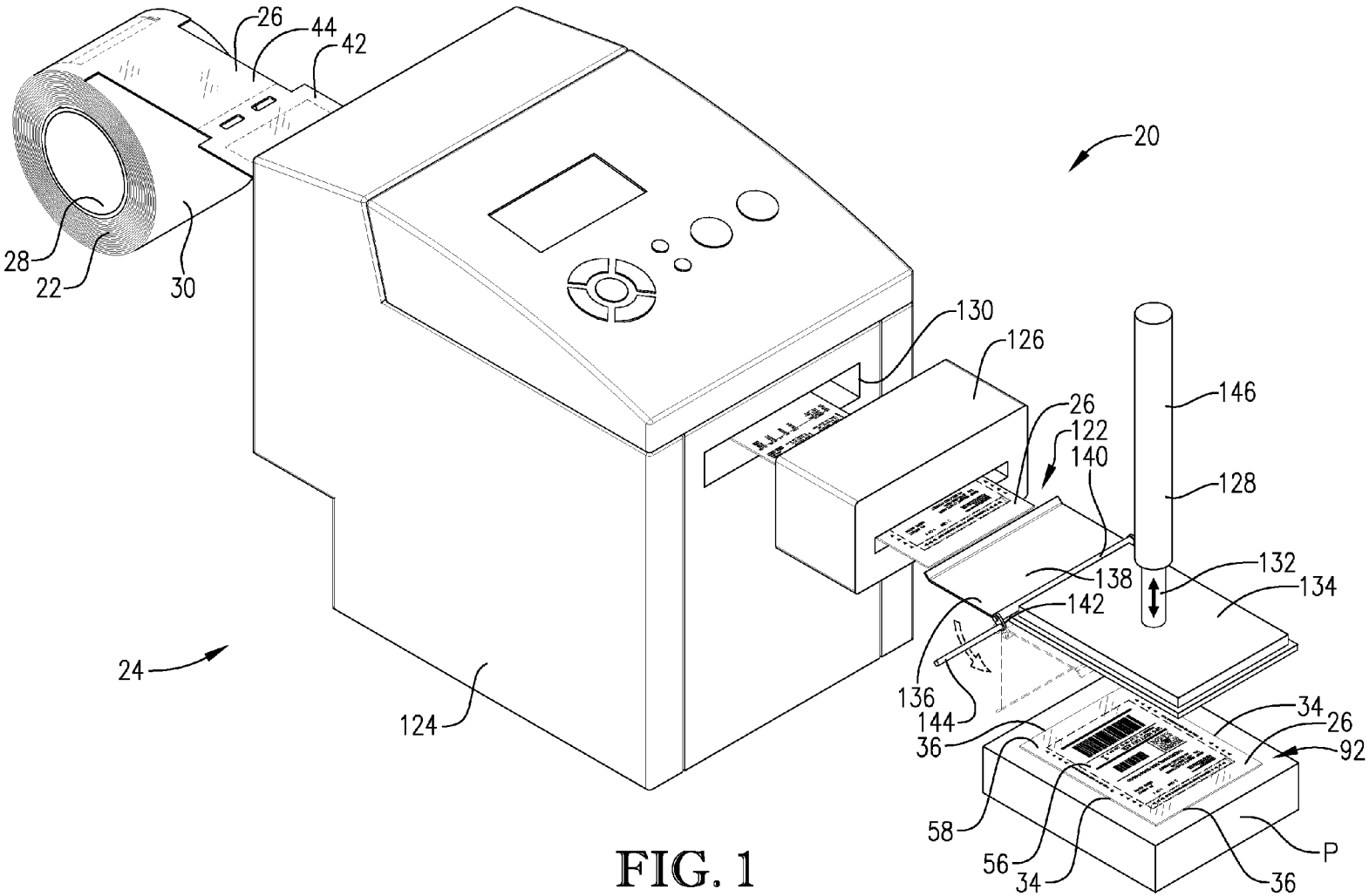
Figure 8:
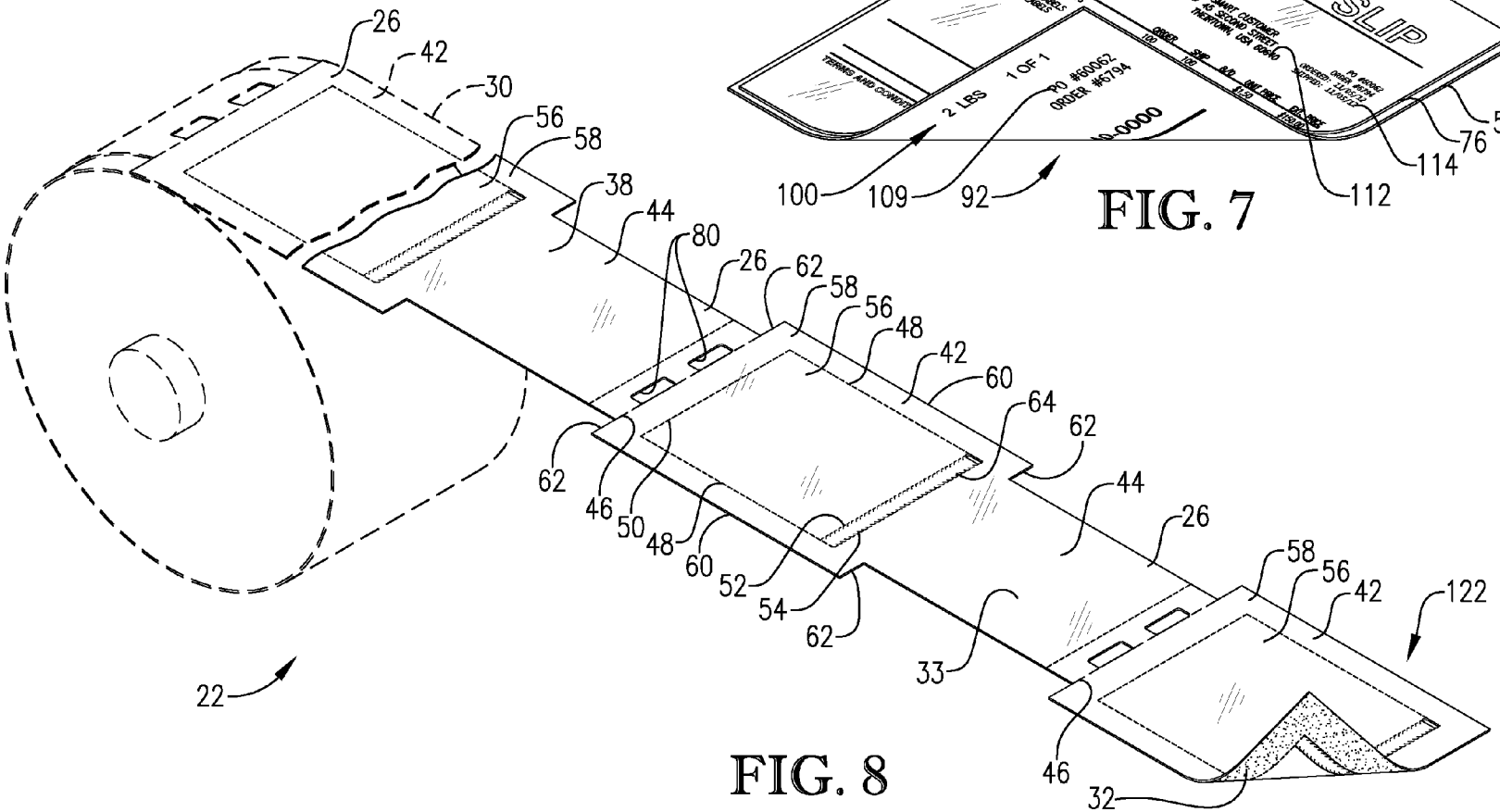
FIG. 8 is a perspective of the label roll shown in FIG. 1, showing the linerless labels of the label roll attached end-to-end.

Turning initially to FIGS. 1 and 8, a linerless label system 20 is constructed in accordance with a first preferred embodiment of the present invention. The label system 20 is configured to provide a foldable adhesive shipping label for application on a package P. The linerless label system 20 broadly includes a linerless label supply 22 and a print and apply station 24.

Turning to FIG. 8, the linerless label supply 22 is preferably in the form of a continuous roll, which provides a plurality of unprinted labels for printing and application onto a substrate as a shipping label. The label roll 22 includes a plurality of linerless labels 26 attached end-to-end and a sleeve 28. In the preferred embodiment, the label roll 22 includes a continuous web of single-ply direct-thermal substrate 30 that presents the end-to-end linerless labels 26, and the continuous web is wound in a roll onto the sleeve 28. As will be discussed further, the linerless labels 26 are detachable from the label roll 22.

Figure 3:
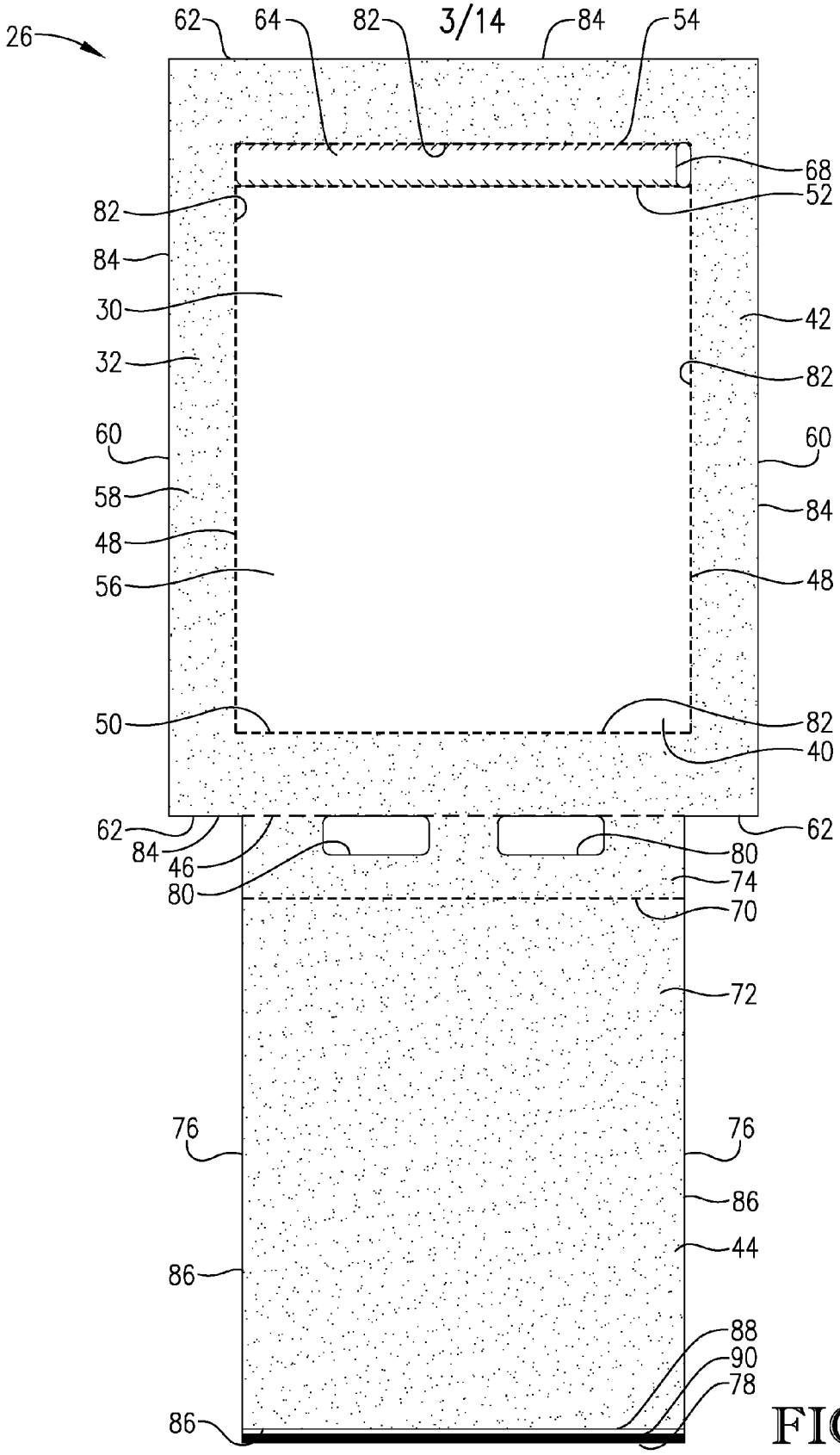
FIG. 3 is a bottom view of the linerless label shown in FIGS. 1 and 2, showing an adhesive layer applied along the packing list section and along the border portion of the shipping label section, and also showing a timing mark that extends along an end of the packing list section.

The linerless labels 26 are each preferably configured to receive packing and shipping information and broadly include thermal printer substrate 30 with an adhesive layer 32, and a release coating 33 (see FIG. 3). The thermal printer substrate 30 preferably comprises a single-ply direct-thermal stock, but other types of single-ply printer stock could be used without departing from the scope of the present invention. When folded for application onto the package P, the preferred label 26 includes opposite folded label side margins 34 that define a folded width dimension Wf thereof and opposite label end margins 36 that define a folded length dimension Lf thereof (see FIG. 5). Preferably, the width dimension Wf is in the range of about 1 inch to about 8 inches and, more preferably, about 3 inches to about 6 inches. The length dimension Lf preferably is in the range of about 1 inch to about 14 inches and, more preferably, about 4 inches to about 10 inches.

The illustrated substrate 30 also presents opposite top and bottom faces 38,40 that are printable by direct-thermal printing methods. However, the principles of the present invention are equally applicable where the substrate 30 is configured to be printed using another printing method, e.g., thermal transfer printing, laser printing, or ink jet printing.

Each linerless label 26 is operable to be folded and adhesively applied to package P. Each linerless label 26 preferably includes upper and lower label sections 42,44 defined on opposite sides of a fold line of weakness 46.

The upper label section 42 preferably includes side perforations 48 and end perforations 50,52,54 that permit the upper label section 42 to be separated into a separable central portion 56 and a surrounding border portion 58. Thus, the perforations 48,50,54 cooperatively provide an endless line of weakness that defines the central portion 56, with the central portion 56 being entirely removable from the border portion 58 along the endless line of weakness. However, it is also within the ambit of the present invention where the upper label section 42 includes an alternative line of weakness, such as a score line. Also, for some aspects of the present invention, the central portion 56 may not be defined by perforations. The perforations 48,50,54 cooperatively define a length dimension Lc and width dimension We of the central portion 56 (see FIG. 5).

In the illustrated embodiment, the border portion 58 preferably presents side edges 60 and end edges 62 of the upper label section 42. While the border portion 58 preferably extends endlessly around the central portion 56, it is within the scope of the present invention where the border portion 58 extends only partly around the central portion 56. For instance, the border portion 58 could extend along three (3) sides of the central portion 56 so that the end of the central portion 56 opposite the tear strip 64 extends to the corresponding end edge 62.

Perforation 52 extends along the central portion 56 between perforations 48 and is inwardly spaced from and adjacent to perforation 54. Perforations 48,52,54 cooperatively define a tear strip 64 of the central portion 56 that connects portions 56,58 of the substrate 30 to each other. The illustrated tear strip 64 is removable to present an unsupported margin 66 of the central portion 56 adjacent to an end of the label 26 (see FIG. 6). The unsupported margin 66 permits a user to grab the central portion 56 and end portion 72 along the margin 66 and remove the central portion 56 and end portion 72 from the rest of the label 26 by pulling the margin 66 in a direction toward the opposite end of the label 26. The illustrated tear strip 64 is preferably positioned at one end of the central portion 56, but could be alternatively positioned (e.g., along one side of the central portion 56) without departing from the scope of the present invention.

The tear strip 64 preferably terminates so that the label 26 forms a label access opening 68. The label access opening 68 provides convenient access to grasp the adjacent end of the tear strip 64. Also, the tear strip 64 is preferably configured so that the tear strip 64 is spaced from the edges 60,62 of the upper label section 42. However, for some aspects of the present invention, one or both ends of the tear strip 64 could be alternatively positioned along the label. For instance, one or both tear strip ends could extend to the respective side edge 60 (e.g., to provide convenient access to the tear strip end). For some aspects of the present invention, the label 26 could also be devoid of tear strip 64 (e.g., where an alternative label access feature is provided so that the user can grasp and remove the portions 56,72). For instance, the label 26 could only have a die cut opening along perforation 54, such as the label access opening 68. Furthermore, the label access feature could comprise a perforation (such as the perforations 48,50, 54).

The lower label section 44 preferably includes a perforation 70 that permits the lower label section 44 to be separated into a separable end portion 72 and a connecting portion 74. The end portion 72 and connecting portion 74 cooperatively present side edges 76 and end edge 78 of the lower label section 44. Also, the perforation 70 provides a dividing line of weakness that defines the end portion 72, with the end portion 72 being entirely removable from the connecting portion 74. However, it is also within the ambit of the present invention where the lower label section 44 includes an alternative line of weakness, such as a score line. Also, for some aspects of the present invention, the end portion 72 may not be defined by a perforation. When the sections 42,44 are folded onto each other, the connecting portion 74 preferably extends across the border portion 58, with the perforation 70 being substantially aligned with the end perforation 50. However, the perforations 50,70 could be longitudinally spaced from each other without departing from the scope of the present invention.

The lower label section 44 preferably presents a width dimension Wo defined by side edges 76 and a length dimension Lo defined by end edge 78 and fold line of weakness 46. The illustrated lower label section 44 is preferably sized so that the width dimension Wo is less than the width dimension Wc. Furthermore, the length dimension Lo is preferably less than the sum of the length dimension Lc and length dimension Lb presented by the border portion 58. However, for some aspects of the present invention, the lower label section 44 could be alternatively sized. For instance, the width dimension Wo could be greater than Wc and less than Wf, and length dimension Lo could be greater than the sum of length dimension Lc and length dimension Lb, while being less than length dimension Lf.

It will be appreciated that the illustrated end portion 72 and connecting portion 74 are preferably configured so that the end portion 72 is positioned entirely inboard of the border portion 58 when the label is folded and applied to package P. However, the end portion 72 and connecting portion 74 may be alternatively configured without departing from the scope of the present invention. For instance, the connecting portion 74 and/or the end portion 72 could be alternatively positioned in a lateral direction between and entirely within the side perforations 48. Also, the portion 72 and/or portion 74 could extend in a lateral direction beyond the illustrated side edges 76. For instance, the portion 72 and/or portion 74 could extend so that one or both of the side edges 76 are aligned with the corresponding side perforation 48. The portion 72 and/or portion 74 could also extend laterally beyond one or both of the side perforations 48. For example, one or both of the side edges 76 could be aligned with the corresponding side edge 60. Furthermore, the portion 72 and/or portion 74 could extend laterally beyond the side edges 60.

In the instance where the end portion 72 extends laterally beyond the side perforations 48, the part of the end portion 72 beyond the side perforation 48 is preferably separated from the rest of the end portion 72 by a longitudinally extending perforation that generally intersects the perforation 70 and is generally laterally aligned with the corresponding side perforation. Thus, for instance, the end portion 72 could have opposite side margins located laterally outboard of the respective side perforation 48, with the end portion 72 presenting opposite longitudinal perforations that are aligned with side perforations 48.

Similarly, when the label is folded, the end portion 72 could be alternatively positioned in a longitudinal direction. The end portion 72 could also extend longitudinally beyond the illustrated end edge 78. For instance, the end portion 72 could extend so that the end edge 78 is aligned with either of the end perforations 52,54 or lies therebetween. The end portion 72 could extend longitudinally beyond the end perforation 54. For example, the end edge 78 could be aligned with the corresponding end edge 62. Furthermore, the end portion 72 could extend longitudinally beyond the end edge 62.

In the event that the end portion 72 extends longitudinally beyond the end perforation 54, the part of the end portion 72 beyond the end perforation 54 is preferably separated from the rest of the end portion 72 by a lateral perforation, with the lateral perforation preferably being substantially aligned with the end perforation 54 when the label 26 is folded about the fold line of weakness 46.

It will be appreciated that the end portion 72 could extend laterally beyond the side perforations 48 and longitudinally beyond the end perforation 54. In that instance, the respective parts of the end portion 72 beyond the side perforations 48 and end perforation 54 are preferably separated from the part of the end portion 72 within the perforations 48,54 by longitudinal and lateral perforations.

The connecting portion 74 of lower label section 44 preferably presents openings 80. The illustrated openings 80 preferably extend to fold line of weakness 46 and are spaced from the perforation 70. However, the openings 80 could be alternatively sized and/or positioned. For instance, the opening 80 could extend longitudinally beyond the fold line of weakness 46 and into the border portion 58. Also, the opening 80 could extend longitudinally up to the perforation 70. For some aspects of the invention, the opening 80 could extend longitudinally beyond the perforation 70 and into the end portion 72 (e.g., so that the opening 80 provides an access to promote separation of the central portion 56 and end portion 72).

The lower label section 44 preferably has a pair of spaced apart openings 80, with each opening 80 preferably having a generally rectangular shape. However, it is within the ambit of the present invention where the lower label section 44 has an alternative number of openings 80. Also, the openings 80 could be alternatively sized or shaped without departing from the scope of the present invention. For instance, the openings 80 could include a square, circle, triangle, or oval shape, or a combination of these shapes. As will be discussed further, the openings 80 preferably permit at least part of the adhesive layer 32 to extend through the lower label section 44.

The illustrated adhesive layer 32 preferably serves to adhere the label 26 to package P. Furthermore, the adhesive layer 32 preferably adheres the upper and lower label sections 42,44 to one another when the label sections 42,44 are folded about the fold line of weakness 46. Preferably, the adhesive layer 32 is applied only along the bottom face 40, with no adhesive being applied along the top face 38. In this manner, the label 26 is configured for printing on the top face 38. However, it is within the scope of the present invention where adhesive is applied on both faces 38,40.

Figure 5:
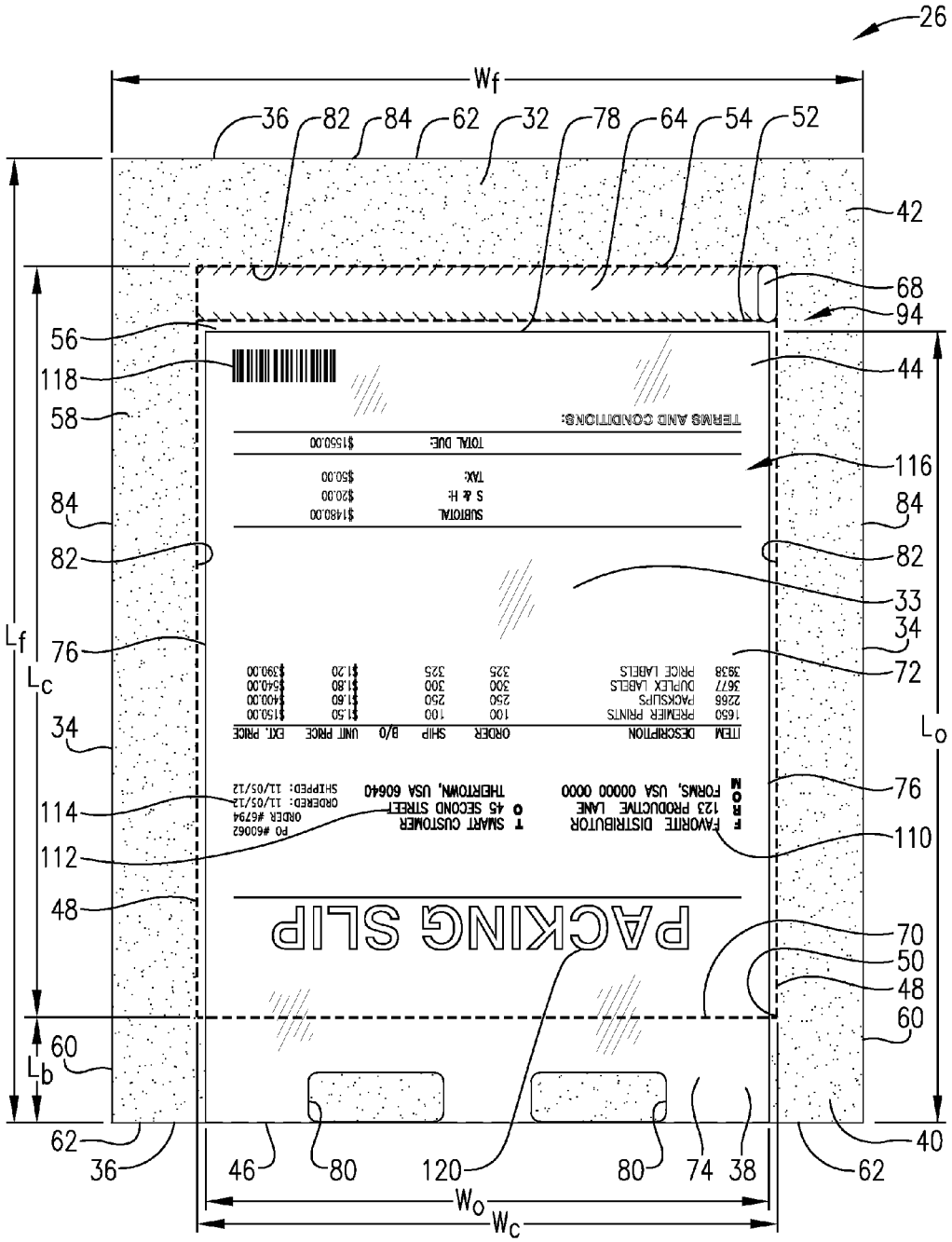
FIG. 5 is a bottom view of the linerless label shown in FIGS. 1-4, showing the linerless label in a folded condition where the sections are adhered to one another, with the end portion adhered to the central portion and the connecting portion adhered to the border portion.

Preferably, part of the adhesive layer 32 is applied in an endless border pattern along the bottom face 40 of the upper label section 42 to present inner and outer adhesive margins 82,84 (see FIGS. 3 and 5). The illustrated adhesive layer 32 preferably extends outwardly so that the outer adhesive margin 84 extends up to edges 60,62, with substantially no part of the bottom face 40 extending outwardly from the outer adhesive margin 84. This preferred arrangement reduces the risk of inadvertent label removal during shipping. However, the principles of the present invention are also applicable where part of the bottom face 40 extends outwardly from the outer adhesive margin 84, e.g., to provide an outer adhesive-free part of the label 26.

The illustrated adhesive layer 32 preferably extends continuously inwardly from the outer adhesive margin 84 to the inner adhesive margin 82, with the endlessly along the border portion 58 so as to substantially cover the entire border portion 58 along the bottom face 40. However, the bottom face 40 of the border portion 58 could have an adhesive free margin that projects from the perforations 48,50,54. Furthermore, the central portion 56 is preferably devoid of adhesive. However, for some aspects of the present invention, adhesive could be applied to part of the central portion 56, e.g., to further adhere the label 26 to the package P.

The central portion 56 is configured to present an adhesive-free section of the bottom face 40, with the adhesive layer 32 preferably surrounding the central portion 56. As discussed, the end portion 72 is preferably located inboard of border portion 58 to securely conceal the printable section when the label 26 is applied to package P. However, the principles of the present invention are applicable where another section of the bottom face 40 along the upper label section 42 is devoid of adhesive (e.g., a section spaced outwardly from the adhesive layer 32). For some aspects of the present invention, some printing could be done on the adhesive layer 32 itself.

Preferably, another part of the adhesive layer 32 is applied along the bottom face 40 of the upper label section 42 to present an outer adhesive margin 86 (see FIG. 3). The outer adhesive margin 86 is preferably spaced from the end edge 78 opposite the openings 80 to provide an endmost adhesive free margin 88. The margin 88 is preferably provided so that a timing mark 90 can be printed on the lower label section 44 (see FIGS. 3 and 4). Where the bottom face 40 of the border portion 58 receives at least part of the adhesive layer 32 (particularly the part of border portion 58 that intersects the fold line of weakness 46), it is within the scope of the present invention where the connecting portion 74 is devoid of adhesive.

The illustrated timing mark 90 presents a thickness of about one-eighth (⅛) inch and extends across the entire width of the lower label section 42. However, it is within the scope of the present invention where the timing mark 90 extends only along part of the width of lower label section 42. For instance, the timing mark 90 could extend from one of the endmost corners of the lower label section 42 along a length of about five-eighths (⅝) of an inch. Also, the label 26 could have opposite timing marks, with each timing mark extending inboard from a respective endmost corner of the lower label section 42.

The area of the bottom face 40 covered by the adhesive layer 32 preferably receives a layer of adhesive that extends continuously therealong. However, it is within the scope of the present invention where the adhesive layer 32 is applied in a noncontinuous adhesive pattern. For instance, the adhesive layer 32 could be applied as a plurality of adhesive dots spaced uniformly along the adhesive area of the bottom face 40.

As part of the linerless label 26, the illustrated adhesive layer 32 preferably comprises a permanent adhesive. As used herein, the term "permanent adhesive" refers to an adhesive that is operable to adhere a label ply to the package P, to another label ply, or to another substrate, with removal of at least part of the label ply from adhesion to the substrate resulting in physical damage to the label ply and/or the substrate, and with the damage being visibly evident to the naked eye. In this manner, the use of permanent adhesive serves to make the applied label 26 tamper-evident. Any of various suitable permanent adhesives, such as pressure sensitive adhesive or heat-activatable adhesive, could be employed to adhere the label ply.

The release coating 33 preferably extends continuously across substantially the entire top face 38. In this manner, the web of labels 26 can be wound onto the roll, with the labels 26 being removably adhered to underlying labels 26.

Again, the connecting portion 74 of lower label section 44 preferably presents openings 80 that extend to fold line of weakness 46. When the upper and lower label sections 42,44 are folded about the fold line of weakness onto one another, the openings 80 each permit a corresponding adhesive layer part 32*a,b* to be exposed and extend through the lower label section 44 for engagement with package P (see FIG. 5). In the illustrated embodiment, the adhesive layer parts 32*a,b* are in substantial registration with the corresponding opening 80. In other words, the adhesive layer parts 32*a,b* preferably fully span the corresponding opening 80. However, for some aspects of the present invention, the adhesive layer parts 32*a,b* could extend across only part of the respective opening 80.

As discussed above, the lower label section 44 could have an alternative number and/or arrangement of openings 80. For instance, connecting portion 74 could have openings that extend to side edges 76 of the connecting portion 74.

Should part of the end portion 72 extend laterally beyond the side perforations 48, as discussed above, this part could also include one or more openings 80, with the additional openings 80 preferably intersecting the side edges 76 of the end portion 72.

Similarly, should part of the end portion 72 extend longitudinally beyond the end perforation 54, as discussed above, this part could include one or more openings 80, with the additional openings 80 preferably intersecting the end edge 78.

If the end portion 72 extends laterally beyond the side perforations 48 and longitudinally beyond the end perforation 54, the respective parts of the end portion 72 beyond the side perforations 48 and end perforation 54 could each include one or more openings 80.

Again, the illustrated label 26 preferably includes a pair of label sections 42,44 folded about the fold line of weakness 46. However, it is within the ambit of the present invention where the label 26 includes more than two label sections foldable onto one another to provide a shipping label. For instance, the label 26 could include two (2) lower label sections attached end-to-end with the upper label section 42, where the lower label sections are attached to one another along a second fold line of weakness. Yet further, the label 26 could have more than two lower label sections, with each adjacent pair of label sections being defined by a corresponding fold line of weakness.

The illustrated label 26 preferably includes top and bottom indicia 92,94 on the top face 38, with the top indicia 92 being applied to the upper label section 42 and the bottom indicia 94 being applied to the lower label section 44. As will be shown, the indicia 92,94 may include variable indicia (i.e., indicia that can vary with each label and associated package P) and non-variable indicia (i.e., indicia that generally does not change from label to label or from order to order). Furthermore, some of the indicia may be preprinted (e.g., before the single-ply substrate is wound into roll 22).

Figure 2:
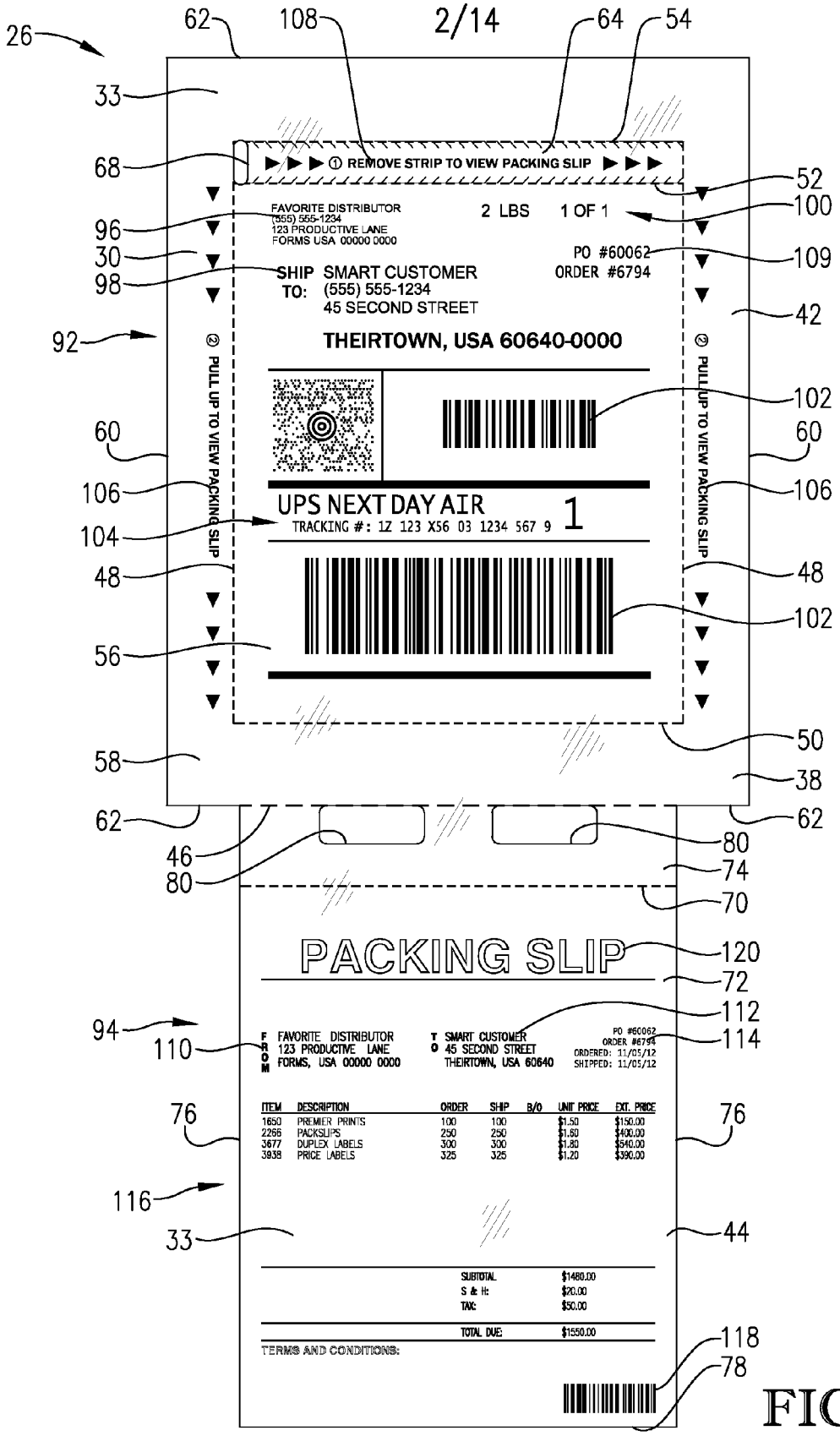
Figure 4:
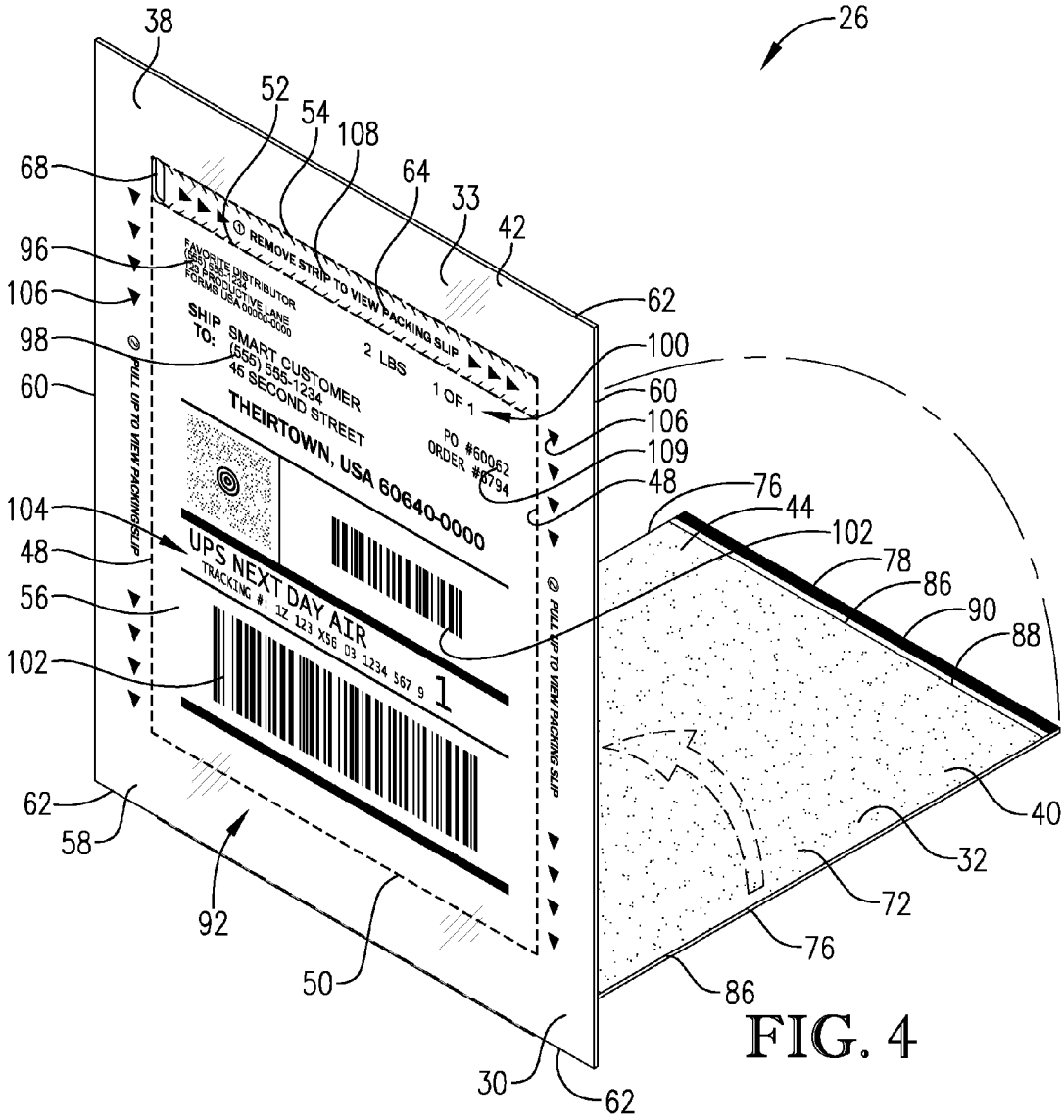
FIG. 4 is a perspective of the linerless label shown in FIGS. 1-3, showing the linerless label being bent along the folding line of weakness so as to fold the packing list section relative to the shipping label section.

Turning to FIGS. 2 and 4, the top indicia 92 presented on the upper label section 42 includes sender address indicia 96, recipient address indicia 98, package size and package number indicia 100, bar code indicia 102 operable to provide a unique identifier associated with the package P that can be electronically scanned, package tracking indicia 104 operable to identify the carrier and a unique carrier tracking number associated with the package P, side margin indicia 106, tear strip indicia 108, and purchase order indicia 109. As will be discussed further, the top indicia 92 is generally exposed and visible when the label 26 is applied to the package P.

Turning to FIGS. 2 and 5, the bottom indicia 94 presented on the top face 38 of the lower label section 44 includes sender address indicia 110, recipient address indicia 112, purchase order indicia 114 that includes a purchase order number, order number, and order and ship dates of the purchase, package contents and billing indicia 116 that provides an itemized list of the package contents, the cost of each item listed alongside the corresponding item, the subtotal, shipping and handling cost, tax, and total cost, bar code indicia 118, and packing slip label indicia 120. The bottom indicia 94 illustrated on the lower label section 44 includes information confidential to the sender and recipient. Therefore, the bottom indicia 94 is printed on the end portion 72 and is generally hidden from view when the label 26 is applied to the package P. However, the principles of the present invention are applicable where at least some indicia printed on the lower label section 44 is printed on another portion of the lower label section 44.

The top and bottom indicia 92,94 are preferably printed by direct-thermal printing, but each of the indicia 92,94 could be printed by other printing methods, such as thermal transfer, laser, ink jet printing, or a combination of printing methods. It is also within the scope of the present invention where some of the top indicia 92 and/or bottom indicia 94 is printed by one printing method and the remainder of the indicia 92,94 is printed by a different printing method. For instance, some part of the indicia 92,94 could be printed by direct-thermal printing and another part of the indicia 92,94 could be printed by thermal transfer printing. Also, some part of the indicia 92,94 could be printed by ink jet printing and another part of the indicia 92,94 could be printed by direct-thermal printing.

Turning again to FIGS. 1-8, the indicia 106,108,120 generally comprise non-variable indicia. Indicia 96,98,100,102, 104,110,112,114,116,118 generally includes variable indicia. Thus, sections 42,44 of the label 26 include variable indicia, and variable indicia on both faces of the label 26 can be associated with a particular order for the contents of package P. As will be discussed further, in printing indicia on both label faces, the indicia on the upper label section 42 can be matched with the indicia on the lower label section 42 to provide all of the indicia associated with the corresponding order. This facilitates proper shipment of the correct items to the correct recipient.

The illustrated label 26 is configured so that confidential indicia, such as the package contents indicia 116, is only located on the lower label section 44 along the end portion 72 and is thereby hidden when the label 26 is applied to package P. Thus, the label 26 must be at least partly removed from the package P to access the confidential indicia.

The top and bottom indicia 92,94 comprise the only information associated with the package P that is carried by the illustrated label 26 for visual and electronic identification (by the sender, distributor, or recipient) of the package P and the associated order. But it is also within the ambit of the present invention where the label 26 includes other package or order identification features, e.g., other types of machine-readable features. For instance, the label 26 could include an RFID tag attached to the substrate 30 that can carry information in electronic form and can be electronically programmed and read.

Turning to FIGS. 1 and 8, the labels 26 are attached end-to-end to form the continuous web, and the web is wound to form the roll 22. In particular, the labels 26 are arranged so that the top and bottom faces 38,40 each extend continuously along the length of the web. Thus, the web is mounted to the sleeve 28 with the adhesive bottom face 40 adhesively engaging the sleeve 28. As the web is wound to form the roll 22, the adhesive bottom face 40 of each label 26 engages and overlies the top face 38 of the underlying label 26 on the roll 22. The adhesive permits removable adhesion between adjacent overlaid labels 26 on the roll 22 so that the labels 26 are removable from each other without becoming damaged. The end-most label 26, i.e., the label at an exposed end 122 of the web, can be removed from overlaid engagement with the label 26 therebelow and can be separated from the web at the timing mark 90 between itself and the adjacent label 26, as will be discussed.

Turning to FIG. 1, the linerless label system 20 is configured to print and apply a shipping label to package P. The print and apply station 24 preferably includes a printer 124, cutter 126, and label applicator 128. The print and apply station 24 is configured to print the label 26 in a single printing pass, as will be discussed. The printer 124 includes a housing that presents a form inlet (not shown) that receives the incoming web and a form outlet 130 through which the printed web is discharged from the printer 124. The illustrated printer 124 includes an upper print head (not shown) positioned within the printer housing for printing indicia on the top face 38. The label roll 22 is rotatably supported by a frame (not shown) adjacent to the form inlet of the printer 124.

As the web passes through the printer 124, the top face 38 is printed by the printer 124 during the single printing pass. The single printing pass may likely involve some back-and-forth movement of the label 26 as the label 26 is being printed. However, it is also within the scope of the present invention where the label 26 is fed continuously through the printer 124 at a constant speed during printing of the label 26.

The illustrated printer 124 preferably includes a direct-thermal printer, but the principles of the present invention are equally applicable where the printer 124 includes another type of print head, such as thermal transfer head, a laser head, or an ink jet head, or a combination of print head types. Furthermore, some of the indicia, particularly the non-variable indicia, could be pre-printed on the continuous web (i.e., prior to printing by the printer 124).

As discussed above, the linerless label system 20 is operable to print the label with variable indicia, such as recipient address indicia 98 and package contents and billing indicia 116. All of the variable indicia printed on label 26 is associated with the particular package P, the contents of the package P, and the recipient of the package. Therefore, the system 20 associates (or matches) all of the variable indicia for each label 26 prior to printing of the label 26. For example, the system 20 could include a computer (not shown) for compiling and associating the information for each label 26. The system 20 also provides printing instructions to the printer 124 so that the associated (or matched) indicia is printed on the same label 26. It is also within the scope of the present invention where only some portions of the variable indicia printed on the label 26 are associated with each other. Also, while the illustrated variable indicia is associated with the corresponding package P, some variable indicia could be associated by another type of association (e.g., the recipient address indicia 98 and the account number of the purchase order indicia 114 can be associated with the name of a recipient).

The cutter 126 comprises a conventional cutting mechanism for cutting the end-most label 26 from the rest of the continuous web. The cutter 126 includes a housing and a cutting blade (not shown). The illustrated cutter 126 includes a sensor (not shown) that identifies when the timing mark 90 reaches the blade, with the cutter 126 then shifting the blade to make a transverse cut along the timing mark 90 to separate the end-most label 26 from the web. However, it is also within the scope of the present invention where the cutter 126 is operable to make a cut along the timing mark 90 without sensing a mark. For instance, the system 20 could be programmed to feed the continuous web a predetermined length and then cut the label 26 to the predetermined length, with the system 20 being operable to cut multiple labels 26 to the same predetermined length. The illustrated cutter 126 is mounted externally to the printer 124, but could be an integral component of the printer 124 without departing from the scope of the present invention. Furthermore, cutting of the end-most label 26 could occur before or after printing of the label 26. While the end-most label 26 is preferably separated from the web by the cutter 126, it is within the scope of the present invention where the end-most label 26 is separated by another mechanism. For instance, the web could include a line of weakness extending along each timing mark 90 and the labels 26 could be separated by a mechanism that bursts or tears the web along the line of weakness.

The label applicator 128 is configured to apply label 26 to package P when the package P is in a labeling position (see FIG. 1). The applicator 128 includes an applicator arm 132, an applicator pad 134 attached to the end of the arm 132, and a label folding mechanism 136. Preferably, the label applicator 128 further includes a vacuum source (not shown) that is operably coupled to the pad 134 and the label folding mechanism 136. The vacuum source is operable to produce a vacuum condition adjacent to a lower pad surface (not shown) of the pad 134 and a lower plate surface of the label folding mechanism 136 so that the vacuum pressure (i.e., pressure less than ambient pressure) provided by the vacuum source is sufficient to hold the label 26 against the lower pad surface and lower plate surface. Also, the vacuum source is operably coupled to a controller (not shown) of the label applicator 128 so that the controller can operate the vacuum source to selectively apply or remove the vacuum condition. Thus, the label applicator 128 is preferably configured so that one of the labels 26 can be held in engagement with the lower pad surface when the vacuum condition is applied.

The label folding mechanism 136 preferably includes a plate 138 pivotally mounted adjacent to the applicator pad 134 at a hinge assembly 140 that includes a pair of arms 142 and pin 144. The plate 138 is shiftable between an unfolded position and a folding position. In the unfolded position (see FIG. 1), the plate 138 is swung so that its lower plate surface is substantially coplanar with the lower pad surface of the applicator pad 134. In the folding position, the plate 138 is swung so that the lower plate surface faces and is substantially parallel to the lower pad surface. The label folding mechanism 136 also includes a drive motor (not shown), such as a pneumatic or electric servo motor, that is operable to rotate the pin 144 to shift the plate 138 between the positions.

The arm 132 is slidably mounted to a housing 146 so that the arm 132 can reciprocate relative to the housing 146. The label applicator 128 also preferably includes a motor (not shown), such as a pneumatic or electric servo motor, drivingly attached to the arm 132 and operable to shift the arm 132 relative to the housing 146. The controller of the label applicator 128 is operably coupled to the motor so that the controller can operate the motor to selectively move the arm 132 and pad 134 between a retracted position (see FIG. 1) and an extended position (not shown). In the retracted position, the pad 134 is preferably spaced from the package P (e.g., to allow shifting of the package P into or out of the labeling position). In the extended position, the pad 134 is positioned adjacent to or in direct contact with package P, when the package P is in the labeling position, to apply the label 26 to the package P.

The illustrated label applicator 128 is operable to locate the pad 134 in the retracted position to receive and hold a label 26 for subsequent application to the package P. In the retracted position, the vacuum condition is applied so that the endmost label 26 separated by the cutter 126 is drawn into engagement with the lower pad surface and the lower plate surface and held in place.

The vacuum condition is preferably maintained as the plate 138 is shifted from the unfolded position to the folding position so that the label 26 is folded about the fold line of weakness 46, with the lower label section 44 being folded onto the upper label section 42. The vacuum condition is preferably removed from the plate 138 and maintained for the applicator pad 134 so that the plate 138 can be swung back to the unfolded position while the folded label 26 is held on the applicator pad 134. For some aspects of the present invention, removal of the vacuum condition from the plate 138 could be done prior to folding of the label 26 by the plate 138. The vacuum condition is preferably maintained as the pad 134 and label 26 are shifted from the retracted position to the extended position.

The label applicator 128 is operable to shift the arm 132 and pad 134 into the extended position to apply the folded label 26 to the package P. The label applicator 128 can then return the arm 132 and pad 134 from the extended position to the retracted position so that another label 26 can be applied to another package.

The illustrated system 20 is preferably configured to operate as an automatic label print and apply station that is electronically operated and can apply printed labels to a plurality of packages P. But the principles of the present invention are applicable where some steps of the label print and application process are performed manually. Because the system 20 is configured to print variable indicia, the system 20 can also apply labels to a plurality of packages P, where each package P has at least some indicia that is different from the other packages P. For instance, the system 20 is operable to print and apply labels to multiple packages P, with each package having different contents and each label 26 having different package contents indicia. Similarly, the recipient address indicia is likely different between each package.

Figure 6:
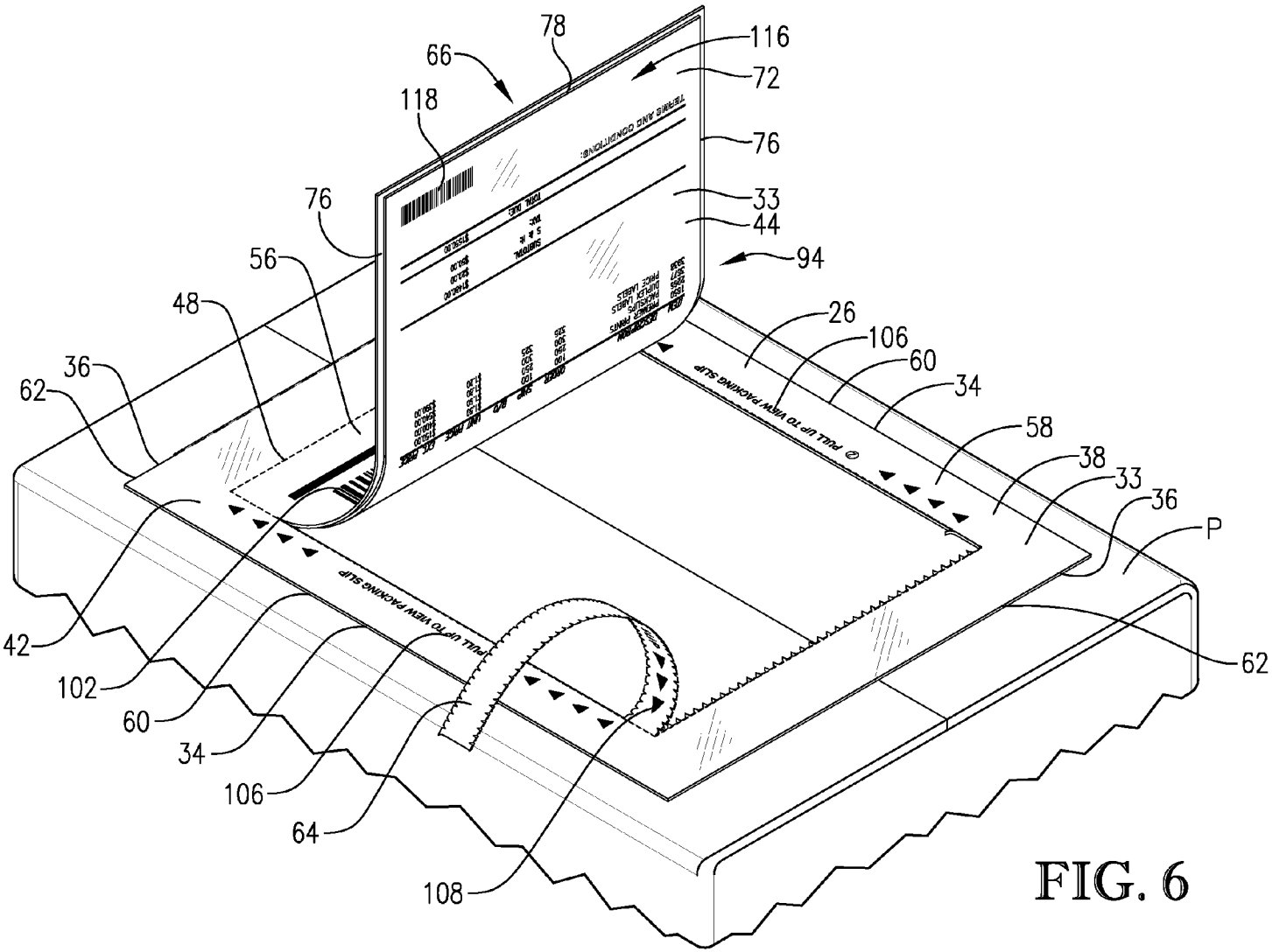
FIG. 6 is an upper perspective of the linerless label shown in FIGS. 1-5, showing the linerless label adhesively applied to a package, with a tear strip of the shipping label section being partly removed from the border portion, and the central portion and the end portion partly removed from the border portion.
Figure 7:
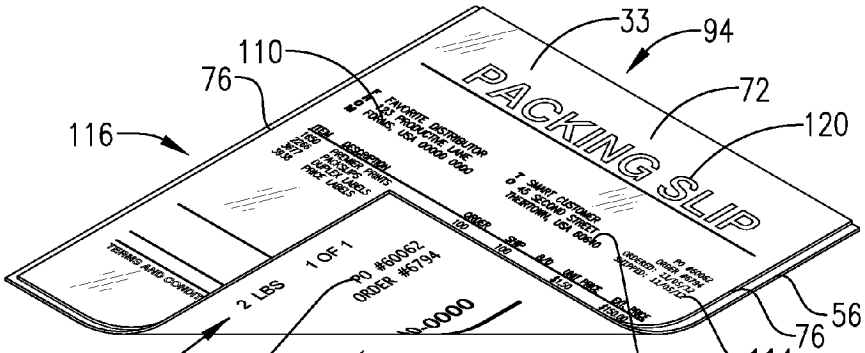
FIG. 7 is a fragmentary perspective of the linerless label shown in FIGS. 1-6, showing the central portion and the end portion entirely removed from the remainder of the label.

Turning to FIGS. 6 and 7, the central portion 56 and end portion 72, which are adhered to one another, are removable from the rest of the label 26 by initially separating the tear strip 64 from the border portion 58. In particular, one end of the tear strip 64 adjacent to the label access opening 68 is grabbed and drawn by the user toward the other end of the tear strip 64. The tear strip 64 can be either partly or completely removed, and this separation of the tear strip 64 leaves the label 26 in an unsecured configuration where the bottom indicia 94 is no longer securely concealed. Furthermore, the unsupported margin 66 of the central portion 56 is exposed to permit the user to grab the central and end portions 56,72. The portions 56,72 can then be drawn away from the endless border portion 58 to separate the portions 56,72 from the border portion 54 to a greater degree and further enable viewing of bottom indicia 94 (see FIG. 6). The portions 56,72 can also be completely detached from the remainder of the label 26. In this instance, the detached portions 56,72 serve as a packing slip that can be processed by the package recipient, e.g., to confirm that the contents ordered were actually shipped in the package, and can be saved as a record of the transaction.

In operation, the linerless label system 20 is operable to efficiently apply packing and shipping labels to multiple packages while minimizing label waste and incidences of equipment failure. The label roll 22 dispenses the continuous web of labels 26 into the print and apply station 24 by unrolling a label 26 from overlaid adhesion with another label 26. That is, an outer label 26 is unrolled from an adjacent inner label 26 by separating the adhesive face of the outer label 26 from the adhesive-free face of the inner label 26. Again, the illustrated labels 26 include no pre-printed indicia, although some pre-printed indicia may be included on the continuous web prior to printing with print and apply station 24 if desired.

As labels 26 pass from the form inlet to the form outlet 130 in a single printing pass, indicia 92,94 is printed on the top face 38. The printed labels 26 then pass out of the form outlet 130 and into the cutter 126 so that the end-most label 26 is separated from the rest of the continuous web. The separated label 26 is then positioned adjacent to the package P, and the label applicator 128 adheres the label 26 onto the package P in a folded condition. The label 26 is folded so that the lower label section 44 lies below the upper label section 42. At the same time, adhesive along the bottom face 40 of the border portion 58 is positioned in adhesive engagement with the package P. Thus, the indicia 94 printed on the lower label section 44 is hidden by the adhered label 26 and package P in a secured label configuration.

In addition, the top face 38 is exposed to permit viewing and electronic scanning of indicia 92 printed thereon. The system 20 is configured to print and apply a plurality of labels 26 to corresponding packages P, with the indicia on each side of the label 26 being matched with each other and with the package P. The bottom indicia 94 printed along the end portion 72 is exposed for viewing by first removing the tear strip 64 from the portions 56,58 to present the unsupported margin 66. The recipient can then grasp the central and end portions 56,72 along the exposed margin 66 to remove the portions 56,72 from the remainder of the label 26, with the end portion 72 thereby serving as a packing slip (or packing list). Without departing from the scope of the present invention, the illustrated end portion 72 could alternatively be used and/or referred to as a carton contents list or an invoice.

Turning to FIGS. 9-15, alternative preferred embodiments of the present invention are depicted. For the sake of brevity, the remaining description will focus primarily on the differences of these alternative embodiments from the preferred embodiment described above.

Initially turning to FIGS. 9 and 10, an alternative label 200 is constructed in accordance with a second embodiment of the present invention. The label 200 preferably includes upper and lower label sections 202,204 defined on opposite sides of a fold line of weakness 206, an adhesive layer 208, a release coating 209, and a release layer 210. The label sections 202, 204 cooperatively present top and bottom faces 212,214 of the label 200.

The upper label section 202 preferably includes side perforations 216 and end perforations 218,220,222 that permit the upper label section 202 to be separated into a separable central portion 224 and a surrounding border portion 226.

The release layer 210 is preferably applied to the bottom face 214 of the central portion 224 between perforations 218,220, but not between perforations 220,222. The release layer 210 is preferably positioned to permit removable adhesion between the central portion 224 an end portion of the lower label section 204.

The lower label section 204 preferably includes a perforation 228 that permits the lower label section 204 to be separated into a separable end portion 230 and a connecting portion 232. The lower label section 204 also presents side edges 234 and end edge 236, with the perforation 228 extending laterally between the side edges 234. The end portion 230 also presents a perforation 238 spaced between ends of the end portion 230.

The illustrated label 200 includes top and bottom indicia 240,242 on the top face 212, with the top indicia 240 being applied to the upper label section 202 and the bottom indicia 242 being applied to the lower label section 204.

The bottom indicia 242 includes return label indicia and packing slip indicia. The return label indicia includes sender address indicia 244, recipient address indicia 246, purchase order indicia 248 that includes tracking indicia, a purchase order number, package number and weight information, and an order number, and bar code indicia 250.

The packing slip indicia includes package contents and billing indicia 252 that provides an itemized list of the package contents, the cost of each item listed alongside the corresponding item, and total cost, credit card indicia 254, order date indicia 256, and packing slip label indicia 258.

Thus, by combining the illustrated arrangement of bottom indicia 242 and perforation 238, the end portion 230 provides a return label 260 and a packing slip 262 that are removable from one another and from the central portion 224. In the illustrated embodiment, the adhesive layer 208 is applied along the bottom face 214 of the return label 260 and packing slip 262. However, it is within the scope of the present invention where the packing slip 262 is devoid of adhesive.

Turning to FIGS. 11 and 12, an alternative label 300 is constructed in accordance with a third embodiment of the present invention. The label 300 preferably includes upper and lower label sections 302,304 defined on opposite sides of a fold line of weakness 306, an alternative adhesive layer 308, and a release coating 309. The label sections 302,304 cooperatively present top and bottom faces 310,312 of the label 300.

The upper label section 302 includes an alternative separable central portion 314 and a surrounding border portion 316 defined by perforations. The central portion 314 preferably presents a generally circular vent opening 317 spaced from the perforations. When the label 300 is folded and is held by the applicator pad, the vent opening 317 allows the vacuum source to apply vacuum to both the upper and lower label sections 302,304. In this manner, the lower label section 304 can be held against the upper label section 302 without the central portion 314 being adhered directly to the lower label section 304.

The lower label section 304 preferably includes a perforation 318 that permits the lower label section 304 to be separated into a separable end portion 320 and a connecting portion 322. The bottom face 312 of end portion 320 is preferably devoid of adhesive. Thus, the bottom face 312 of the end portion 320 can be printed with indicia. Because the end portion 320 and the central portion 314 are both devoid of adhesive, the end portion 320 can be separated from the connecting portion 322 and removed entirely from the remainder of the label 300.

The illustrated label 300 includes top and bottom indicia 324,326 on the top face 310. The label 300 also includes top and bottom indicia 328,330 on the bottom face 312. The top indicia 328 includes terms and conditions indicia, and return information indicia. The bottom indicia 330 includes company logo indicia and company website and information indicia.

Turning to FIGS. 13 and 14, an alternative label 400 is constructed in accordance with a fourth embodiment of the present invention. The label 400 preferably includes upper and lower label sections 402,404 defined on opposite sides of a fold line of weakness 406, an alternative adhesive layer 408, and a release coating 409. The label sections 402,404 cooperatively present top and bottom faces 410,412 of the label 300.

The upper label section 402 includes a separable central portion 414 and a surrounding border portion 416. The lower label section 404 preferably includes a perforation 418 that permits the lower label section 404 to be separated into a separable end portion 420 and a connecting portion 422.

The end portion 420 presents a perforation 424 spaced between the ends of the end portion 420, with the perforation 424 dividing the end portion 420 into a central segment 426 and an end segment 428.

The bottom face 412 of central segment 426 is preferably devoid of adhesive. Thus, the bottom face 412 of the central segment 426 can be printed with indicia. Because the central segment 426 and the central portion 414 are both devoid of adhesive, the central segment 426 can be separated from the connecting portion 422 and end segment 428 along corresponding perforations, and can be removed entirely from the remainder of the label 400.

The illustrated label 400 includes top and bottom indicia 430,432 on the top face 410. The label 400 also includes top and bottom indicia 434,436 on the bottom face 412. The top indicia 434 on the bottom face 412 includes terms and conditions indicia. The bottom indicia 436 on the bottom face 412 includes return information indicia.

The bottom indicia 432 on the top face 410 includes return label indicia. The return label indicia includes sender address indicia 438, recipient address indicia 440, purchase order indicia 442 that includes tracking indicia, a purchase order number, package number and weight information, and an order number, and bar code indicia 444.

Thus, by combining the illustrated arrangement of bottom indicia 432 and perforation 424, the end portion 420 provides a return label 446 that is removable from the central portion 414.

Turning to FIG. 15, an alternative linerless label system 500 is constructed in accordance with a fifth embodiment of the present invention. The label system 500 broadly includes a linerless label supply 502 with labels 503 and a print and apply station 504. The labels 503 include a substrate and an adhesive layer (not shown). However, the illustrated labels 503 are preferably devoid of a release coating. As will be discussed, the adhesive layer of labels 503 is preferably a heat-activatable adhesive layer. The print and apply station 504 preferably includes a printer 506, cutter 508, and label applicator 510.

The label applicator 510 includes an applicator arm 512, an applicator pad 514 attached to the end of the arm 512, and a label folding mechanism 516. The label folding mechanism 516 includes a plate 518 swingably mounted adjacent to the applicator pad 514.

The illustrated label applicator 510 also preferably provides an adhesive-activating station. In particular, the applicator 510 preferably also includes a heating element 520 mounted within the applicator pad 514 and a heating element 522 mounted to the plate 518. The heating elements 520,522 serve to activate the heat-activatable adhesive material of the label 503. The heating element 520 is preferably mounted adjacent to the lower pad surface of the pad 514. Similarly, the heating element 522 is preferably mounted adjacent to the lower plate surface of plate 518. However, the label folding mechanism 516 could be devoid of a heating element without departing from the scope of the present invention. For instance, the entire adhesive layer could be activated by the heating element 520 after the label 503 is folded.

The labels 503 each preferably have the heat-activatable adhesive layer applied to the bottom face of the label 503. One suitable heat-activatable adhesive is available as Silgon™ Linerless Adhesive from Polykote Corp. of Easton, Pa. For some aspects of the present invention, the adhesive layer could include another type of activable adhesive, such as a water-activatable adhesive or a light-activatable adhesive. For instance, suitable water-activatable adhesives may include remoistenable glues, gums, and hot-melt extruded glues. Also, the illustrated activatable adhesive layer preferably comprises a permanent adhesive.

Preferably, activation of the adhesive material of label 503 is performed after the label 503 is positioned in engagement with the pad 514, although adhesive activation could occur prior to pad engagement. When wound onto the roll, each label 503 preferably has adhesive that is unactivated so that each pair of labels 503 in overlying contact with one another have substantially no adhesion therebetween. Because the adhesive is selectively activatable, the adhesive on each label 503 is preferably activated after the label 503 is removed from the roll. The combined functionality of adhesive activation and label application provided by the illustrated label applicator 510 has been found to be particularly effective for systems that perform label application using a machine, such as an automated label application machine.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A shipping label operable to be applied to a package, said shipping label comprising:

a single label ply presenting longitudinally spaced ends, opposite top and bottom faces extending between the ends, and a generally transverse fold line of weakness spaced between the ends, said label ply being foldable about the fold line to define upper and lower label sections, with the upper label section overlying the lower label section when the label ply is folded, and the top face of the upper label section being operable to receive package address indicia thereon, said upper label section including a separation line of weakness defining a border portion and a separable central portion, said upper label section including adhesive applied to the bottom face along at least part of the border portion, said lower label section including a dividing line of weakness defining a connecting portion and an end portion, with the connecting portion extending between the fold line and dividing line, said end portion being at least in part positioned underneath the central portion of the upper label section when the label ply is folded, with separation of the central portion from the border portion providing access to the end portion thereunder, said connecting portion including an opening that projects from the fold line, said adhesive on the bottom face of the upper label section extending from the fold line to be in registration with the opening when the label ply is folded, such that the upper label section is configured to adhesively attach to the package along the fold line.

2. The shipping label as claimed in claim 1, at least some of the adhesive applied to the bottom face of the upper label section being positioned outboard of the end portion when the label ply is folded, such that the upper label section is configured to adhesively attach to the package at least partly around the end portion.

3. The shipping label as claimed in claim 2, said lower label section having a narrower transverse dimension than the upper label section.

4. The shipping label as claimed in claim 2, said adhesive on the bottom face of the upper label section extending substantially continuously about the central portion, said end portion being located substantially entirely underneath the central portion when the label ply is folded.

5. The shipping label as claimed in claim 4,
said lower label section including adhesive applied to the bottom face along the end portion so that the end portion is adhesively coupled to the central portion when the label ply is folded.

6. The shipping label as claimed in claim 5,
said upper label section including a release coating applied to the bottom face along the central portion such that the end portion and central portion are releasably adhered to one another when the label ply is folded.

7. The shipping label as claimed in claim 5,
said end portion being only partially coated with adhesive, such that end portion is partially unattached from the central portion when the label ply is folded.

8. The shipping label as claimed in claim 7,
said end portion including a detachment line of weakness defined between the unattached and adhesively attached parts of the end portion.

9. The shipping label as claimed in claim 5,
said end portion including a detachment line of weakness spaced from the dividing line,
said detachment line defining separable parts of the end portion.

10. The shipping label as claimed in claim 9,
said lower label section including adhesive along both of the parts thereof.

11. The shipping label as claimed in claim 2,
said central portion presenting a vent opening spaced from the separation line.

12. The shipping label as claimed in claim 2,
said separation line being endless such that the border portion extends continuously about the central portion,
said connecting portion extending across the border portion when the label ply is folded.

13. The shipping label as claimed in claim 12,
said dividing line being substantially aligned with the separation line of the upper label section when the label ply is folded.

14. The shipping label as claimed in claim 12,
said adhesive covering substantially the entire border portion.

15. The shipping label as claimed in claim 14,
said lower label section including adhesive applied to the bottom face along the substantially the entire end portion so that the end portion is adhesively coupled to the central portion when the label ply is folded.

16. The shipping label as claimed in claim 15,
said end portion being located inboard of the border portion when the label ply is folded.

17. The shipping label as claimed in claim 1,
said label being linerless.

18. The shipping label as claimed in claim 1,
said dividing line being generally linear,
said opening being generally rectangular in shape.

19. The shipping label as claimed in claim 18,
said opening including a pair of holes spaced apart along the dividing line.

20. The shipping label as claimed in claim 1,
said top face of the label ply being devoid of adhesive.

21. A linerless label roll operable to provide linerless labels for packages, said linerless label roll comprising:
a continuous web of a foldable single ply substrate wound in a roll,
said single ply substrate presenting a plurality of end-to-end labels,
each of said labels presenting longitudinally spaced ends, opposite top and bottom faces extending between the ends, and a generally transverse fold line of weakness spaced between the ends,
said label being foldable about the fold line to define upper and lower label sections, with the upper label section overlying the lower label section when the label is folded, and the top face of the upper label section being operable to receive package address indicia thereon,
said upper label section including a separation line of weakness defining a border portion and a separable central portion,
said lower label section including a dividing line of weakness defining a connecting portion and an end portion, with the connecting portion extending between the fold line and dividing line,
said end portion presenting a narrower transverse dimension than the upper label section, such that the border portion includes longitudinally extending side margins laterally outboard of the end portion,
said end portion being at least in part positioned underneath the central portion of the upper label section when the label is folded, with separation of the central portion from the border portion providing access to the end portion thereunder,
said upper label section including adhesive applied to the bottom face along at least part of each of the side margins of the border portion, such that the upper label section is configured to adhesively attach to the package along the side margins,
said adhesive on the bottom face of the upper label section permitting removable contact of overlaid bottom and top faces of labels within the roll,
said connecting portion including an opening that projects from the fold line,
said adhesive on the bottom face of the upper label section extending from the fold line to be in registration with the opening when the label is folded, such that the upper label section is configured to adhesively attach to the package along the fold line.

22. The linerless label roll as claimed in claim 21,
said adhesive on the bottom face of the upper label section comprising an unactivated, selectively activatable adhesive layer,
said bottom face of each label removably contacting the top face of one of the labels within the roll without any substantial adhesion therebetween so that, once the bottom face is removed, the adhesive layer may be activated and the label adhered to the package.

23. The linerless label roll as claimed in claim 21,
said dividing line being generally linear,
said opening being generally rectangular in shape.

24. The linerless label roll as claimed in claim 23,
said opening including a pair of holes spaced apart along the dividing line.

25. The linerless label roll as claimed in claim 21,
said lower label section having a narrower transverse dimension than the upper label section.

26. The linerless label roll as claimed in claim 21,
said adhesive on the bottom face of the upper label section extending substantially continuously about the central portion,
said end portion being located substantially entirely underneath the central portion when the label is folded.

27. The linerless label roll as claimed in claim 26, said lower label section including adhesive applied to the bottom face along the end portion so that the end portion is adhesively coupled to the central portion when the label is folded.

28. The linerless label roll as claimed in claim 27, said upper label section including a release coating applied to the bottom face along the central portion such that the end portion and central portion are releasably adhered to one another when the label is folded.

29. The linerless label roll label as claimed in claim 27, said end portion being only partially coated with adhesive, such that end portion is partially unattached from the central portion when the label is folded.

30. The linerless label roll as claimed in claim 29, said end portion including a detachment line of weakness defined between the unattached and adhesively attached parts of the end portion.

31. The linerless label roll as claimed in claim 27, said end portion including a detachment line of weakness spaced from the dividing line, said detachment line defining separable parts of the end portion.

32. The linerless label roll as claimed in claim 31, said lower label section including adhesive along both of the parts thereof.

33. The linerless label roll as claimed in claim 21, said central portion presenting a vent opening spaced from the separation line.

34. The linerless label roll as claimed in claim 21, said separation line being endless such that the border portion extends continuously about the central portion, said connecting portion extending across the border portion when the label is folded.

35. The linerless label roll as claimed in claim 34, said dividing line being substantially aligned with the separation line of the upper label section when the label is folded.

36. The linerless label roll as claimed in claim 34, said adhesive covering substantially the entire border portion.

37. The linerless label roll as claimed in claim 36, said lower label section including adhesive applied to the bottom face along the substantially the entire end portion so that the end portion is adhesively coupled to the central portion when the label is folded.

38. The linerless label roll as claimed in claim 37, said end portion being located inboard of the border portion when the label is folded.

39. The linerless label roll as claimed in claim 21, said top face of the label being devoid of adhesive.

40. A labeled package assembly to be shipped to a recipient, said labeled package assembly comprising:

a package containing at least one item to be received by the recipient; and a single ply combination shipping label and packing list label applied to the package in a folded condition, said label presenting longitudinally spaced ends, opposite top and bottom faces extending between the ends, and a generally transverse fold line of weakness spaced between the ends, said label being folded about the fold line to define upper and lower label sections, with the upper label section overlying the lower label section, said top face of the upper label section carrying publicly displayed package address indicia associated with the recipient, and said top face of the lower label section carrying hidden package contents indicia listing the at least one item, said upper label section including a separation line of weakness defining a border portion and a separable central portion, said upper label section including adhesive applied to the bottom face along at least part of the border portion, said lower label section including a dividing line of weakness defining a connecting portion and an end portion, with the connecting portion extending between the fold line and dividing line, said end portion being at least in part positioned underneath the central portion of the upper label section, with separation of the central portion from the border portion providing access to the end portion thereunder, said package contents indicia being provided on the end portion so as to be concealed by the upper label section, said connecting portion including an opening that projects from the fold line, said adhesive on the bottom face of the upper label section extending from the fold line to be in registration with the opening, such that the upper label section is configured to adhesively attach to the package along the fold line.

41. The labeled package assembly as claimed in claim 40, at least some of the adhesive applied to the bottom face of the upper label section being positioned outboard of the end portion, such that the upper label section is adhesively attached to the package at least partly around the end portion.

42. The labeled package assembly as claimed in claim 41, said lower label section having a narrower transverse dimension than the upper label section.

43. The labeled package assembly as claimed in claim 41, said adhesive on the bottom face of the upper label section extending substantially continuously about the central portion, said end portion being located substantially entirely underneath the central portion.

44. The labeled package assembly as claimed in claim 43, said lower label section including adhesive applied to the bottom face along the end portion so that the end portion is adhesively coupled to the central portion.

45. The labeled package assembly as claimed in claim 44, said upper label section including a release coating applied to the bottom face along the central portion such that the end portion and central portion are releasably adhered to one another.

46. The labeled package assembly as claimed in claim 44, said end portion being only partially coated with adhesive, such that end portion is partially unattached from the central portion.

47. The labeled package assembly as claimed in claim 46, said end portion including a detachment line of weakness defined between the unattached and adhesively attached parts of the end portion.

48. The labeled package assembly as claimed in claim 44, said end portion including a detachment line of weakness spaced from the dividing line, said detachment line defining separable parts of the end portion.

49. The labeled package assembly as claimed in claim 48, said lower label section including adhesive along both of the parts thereof.

50. The labeled package assembly as claimed in claim 41, said central portion presenting a vent opening spaced from the separation line.

51. The labeled package assembly as claimed in claim 41, said separation line being endless such that the border portion extends continuously about the central portion, said connecting portion extending across the border portion.

52. The labeled package assembly as claimed in claim 51, said dividing line being substantially aligned with the separation line of the upper label section.

53. The labeled package assembly as claimed in claim 51, said adhesive covering substantially the entire border portion.

54. The labeled package assembly as claimed in claim 53, said lower label section including adhesive applied to the bottom face along the substantially the entire end portion so that the end portion is adhesively coupled to the central portion.

55. The labeled package assembly as claimed in claim 54, said end portion being located inboard of the border portion.

56. The labeled package assembly as claimed in claim 40, said label being linerless.

57. The labeled package assembly as claimed in claim 40, said dividing line being generally linear, said opening being generally rectangular in shape.

58. The labeled package assembly as claimed in claim 57, said opening including a pair of holes spaced apart along the dividing line.

59. The labeled package assembly as claimed in claim 40, said top face of the label being devoid of adhesive.

60. The labeled package assembly as claimed in claim 40, said address indicia being provided on the central portion of the upper label section.

61. The labeled package assembly as claimed in claim 40, said address indicia and package contents indicia face opposite directions.

* * * * *